US007616908B2

(12) United States Patent
Watanabe et al.

(10) Patent No.: US 7,616,908 B2
(45) Date of Patent: Nov. 10, 2009

(54) IMAGE FORMING APPARATUS AND METHOD HAVING EXPOSURE CONTROL DEPENDING ON FIRST AND SECOND DENSITY PATCHES

(75) Inventors: Takeshi Watanabe, Yokohama (JP); Daisuke Yamashita, Izunokuni (JP); Sunao Takenaka, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 415 days.

(21) Appl. No.: 11/477,234

(22) Filed: Jun. 29, 2006

(65) Prior Publication Data

US 2008/0003003 A1 Jan. 3, 2008

(51) Int. Cl.
*G03G 15/00* (2006.01)

(52) U.S. Cl. ..... 399/49; 399/51

(58) Field of Classification Search ..... 399/49, 399/51, 32; 347/131, 252, 253, 254
See application file for complete search history.

(56) References Cited

U.S. PATENT DOCUMENTS

| | | | | |
|---|---|---|---|---|
| 5,380,610 | A * | 1/1995 | Haneda et al. | 430/31 |
| 6,215,968 | B1 * | 4/2001 | Uehara et al. | 399/49 |
| 6,223,007 | B1 * | 4/2001 | Kitagawa et al. | 399/49 |
| 6,239,824 | B1 * | 5/2001 | Mutou et al. | 347/131 |
| 6,288,733 | B1 * | 9/2001 | Nakazawa et al. | 347/133 |
| 6,501,917 | B1 * | 12/2002 | Karasawa | 399/46 |
| 6,516,162 | B2 * | 2/2003 | Ino et al. | 399/49 |
| 6,700,595 | B2 * | 3/2004 | Sugiyama et al. | 347/133 |
| 7,567,761 | B2 * | 7/2009 | Kin et al. | 399/12 |
| 2001/0033755 | A1 | 10/2001 | Ino et al. | |
| 2002/0126196 | A1 * | 9/2002 | Yamauchi | 347/129 |
| 2005/0286086 | A1 * | 12/2005 | Takahashi et al. | 358/3.26 |
| 2006/0140650 | A1 * | 6/2006 | Yokote | 399/27 |
| 2008/0025741 | A1 * | 1/2008 | Yamashita et al. | 399/49 |

FOREIGN PATENT DOCUMENTS

| | | | |
|---|---|---|---|
| JP | 03-271763 | | 12/1991 |
| JP | 06-083149 | | 3/1994 |
| JP | 09272222 | A * | 10/1997 |
| JP | 11-194553 | | 7/1999 |
| JP | 2000052590 | A * | 2/2000 |
| JP | 2000-127511 | | 5/2000 |

(Continued)

*Primary Examiner*—Robert Beatty
(74) *Attorney, Agent, or Firm*—Turocy & Watson, LLP

(57) ABSTRACT

An image forming apparatus according to an aspect of this invention includes: a photoconductive unit; an exposure unit outputting a pulse-width-modulated light signal and exposing the photoconductive unit; a developing unit developing the photoconductive unit and forming a developed image on the photoconductive unit; a transfer unit transferring the developed image to a transfer target unit and forming a transferred image; an image patch generating unit generating an image patch formed by a predetermined pattern; a sensor unit detecting density information of the developed image of the image patch formed on the photoconductive unit or the transferred image of the image patch formed on the transfer target unit; and an image quality maintenance control unit deciding a proper quantity of exposure and a proper pulse width on the basis of the density information detected by the sensor unit and set the decided proper quantity of exposure and the proper pulse width in the exposure unit.

18 Claims, 18 Drawing Sheets

FOREIGN PATENT DOCUMENTS

| | | | | |
|---|---|---|---|---|
| JP | 2000127499 | A | * | 5/2000 |
| JP | 2002214859 | A | * | 7/2002 |
| JP | 2003287931 | A | * | 10/2003 |
| JP | 2005242145 | A | * | 9/2005 |
| JP | 2006-011171 | | | 1/2006 |

* cited by examiner

| TEST NO. | CONTROL BASED ON MICRO-POINT PATCH | CONTROL BASED ON SOLID PATCH PRINTING | RECOGNITION OF THIN LINE, MICRO-POINT AND SOLID PART | CORRECTION BY GRADATION CORRECTION CURVE | PHOTOCONDUCTIVE UNIT HALF-POTENTIAL EXPOSURE QUANTITY (μJ/Cm2) | NORMAL-TEMPERATURE NORMAL-HUMIDITY ENVIRONMENT, 21℃ 50% | | | | AFTER LEAVING 8 HOURS OR MORE IN HIGH-TEMPERATURE HIGH-HUMIDITY ENVIRONMENT, 30℃ 80% | | | LOW-TEMPERATURE LOW-HUMIDITY ENVIRONMENT 10℃ 20% + USED-UP PHOTOCONDUCTIVE UNIT | | |
|---|---|---|---|---|---|---|---|---|---|---|---|---|---|---|---|
| | | | | | | QUANTITY OF EXPOSURE (μJ/Cm2) | SOLID PART PWM VALUE | MICRO-POINT REPRODUCIBILITY | SOLID DENSITY | MICRO-POINT REPRODUCIBILITY | SOLID DENSITY | GRADATION CHARACTERISTIC (MAXIMUM DIFFERENCE FROM NORMAL-TEMPERATURE NORMAL-HUMIDITY ENVIRONMENT) | MICRO-POINT REPRODUCIBILITY | SOLID DENSITY | GRADATION CHARACTERISTIC (MAXIMUM DIFFERENCE FROM NORMAL-TEMPERATURE NORMAL-HUMIDITY ENVIRONMENT) |
| 1 | MANUALLY ADJUST MICRO-POINT AND SOLID DENSITIES WITHOUT PRINTING PATCH | | NO | NO | 0.2 | 0.6 | 255 | ○ | 1.5 | | | | | | |
| 2 | | | | | | 0.5 | 255 | ○ | 1.5 | | | | | | |
| 3 | | | | | | 0.4 | 255 | ○ | 1.6(△) | | | | | | |
| 4 | | | | | | 0.4 | 255 | △ | 1.5 | | | | | | |
| 5 | | | | | | 0.3 | 255 | ○ | 1.7 | | | | | | |
| 6 | | | | | | 0.3 | 255 | × | 1.5 | | | | | | |
| 7 | | | | | 0.4 | 1 | 255 | ○ | 1.5 | | | | | | |
| 8 | | | | | | 0.8 | 255 | ○ | 1.6(△) | | | | | | |
| 9 | | | | | | 0.6 | 255 | △ | 1.5 | | | | | | |
| 10 | | | | | | 0.5 | 255 | × | 1.5 | | | | | | |
| 11 | QUANTITY OF EXPOSURE, THREE KINDS | PWM, THREE KINDS | YES | | 0.2 | 0.31 | 200 | ○ | 1.5 | ○ | 1.5 | 0.16 | ○ | 1.48 | 0.14 |
| 12 | QUANTITY OF EXPOSURE, TWO KINDS | | | | | 0.3 | 208 | ○ | 1.5 | ○ | 1.5 | 0.16 | ○ | 1.47 | 0.15 |
| 13 | QUANTITY OF EXPOSURE, ONE KIND | | | | | 0.29 | 216 | ○ | 1.5 | ○ | 1.51 | 0.17 | ○ | 1.46 | 0.14 |
| 14 | QUANTITY OF EXPOSURE, THREE KINDS | PWM, TWO KINDS | | | | 0.31 | 200 | ○ | 1.48 | ○ | 1.5 | 0.16 | ○ | 1.47 | 0.1 |
| 15 | QUANTITY OF EXPOSURE, TWO KINDS | | | | | 0.3 | 200 | ○ | 1.46 | ○ | 1.53 | 0.18 | ○ | 1.46 | 0.18 |
| 16 | QUANTITY OF EXPOSURE, ONE KIND | | | | | 0.29 | 208 | ○ | 1.47 | ○ | 1.53 | 0.16 | ○ | 1.44 | 0.16 |
| 17 | QUANTITY OF EXPOSURE, THREE KINDS | PWM, ONE KIND | | | | 0.31 | 192 | ○ | 1.48 | ○ | 1.54 | 0.17 | ○ | 1.44 | 0.17 |
| 18 | QUANTITY OF EXPOSURE, TWO KINDS | | | | | 0.3 | 200 | ○ | 1.47 | ○ | 1.53 | 0.19 | ○ | 1.44 | 0.19 |
| 19 | QUANTITY OF EXPOSURE, ONE KIND | | | | | 0.29 | 208 | ○ | 1.46 | ○ | 1.55 | 0.18 | ○ | 1.41 | 0.18 |
| 20 | QUANTITY OF EXPOSURE, THREE KINDS | PWM, THREE KINDS (SIMULTANEOUS PRINTING WITH MICRO-POINT PATCH) | | EXECUTE WITH 80/255, 160/255 PATCHES | | 0.31 | 200 | ○ | 1.47 | ○ | 1.49 | 0.05 | ○ | 1.45 | 0.04 |
| 21 | QUANTITY OF EXPOSURE, ONE KIND | | | | | 0.29 | 208 | ○ | 1.44 | ○ | 1.5 | 0.06 | ○ | 1.43 | 0.04 |
| 22 | QUANTITY OF EXPOSURE, THREE KINDS | PWM, ONE KIND (SIMULTANEOUS PRINTING WITH MICRO-POINT PATCH) | | | | 0.31 | 192 | ○ | 1.45 | ○ | 1.55 | 0.05 | ○ | 1.43 | 0.05 |
| 23 | QUANTITY OF EXPOSURE, ONE KIND | | | | | 0.29 | 200 | ○ | 1.42 | ○ | 1.54 | 0.06 | ○ | 1.4 | 0.05 |
| 24 | QUANTITY OF EXPOSURE, THREE KINDS | NO CHANGE OF PWM | | EXECUTE WITH 64/255, 114/255, 160/255 PATCHES | | 0.31 | 255 | ○ | 1.5 | ○ | 1.5 | 0.04 | ○ | 1.49 | 0.04 |
| 25 | QUANTITY OF EXPOSURE, ONE KIND | | | | | 0.29 | 255 | ○ | 1.5 | ○ | 1.54 | 0.06 | ○ | 1.52 | 0.06 |

FIG. 21

IMAGE FORMING APPARATUS AND METHOD HAVING EXPOSURE CONTROL DEPENDING ON FIRST AND SECOND DENSITY PATCHES

BACKGROUND OF THE INVENTION

1. Technical Field of the Invention

This invention relates to an image forming apparatus and image forming method, and particularly to an image forming apparatus and image forming method for forming an image using an electrophotographic process.

2. Related Art

In an electrophotographic image forming apparatus, it is known that the characteristics of electrophotographic materials such as toner and photoconductive unit are changed by the variance in ambient environment such as temperature and humidity and the time period during which the apparatus is used, thus changing the density of a formed image. As a result, for example, halftone density of the image changes and a micro-point or line cannot be reproduced in the same size.

Thus, in many of the recent image forming apparatuses, an image quality adjustment mechanism is installed in order to prevent change in halftone density or secure reproducibility of a micro-point or line.

The image quality adjustment mechanism uses a method of maintaining the image quality by open-loop control, a method of maintaining the image quality by closed-loop control, a method combining these, or the like.

In the open-loop control, the environmental conditions, time period during which the apparatus is used and the like are monitored, and the process conditions such as quantity of exposure are changed by using a table provided in advance in the image forming apparatus, thereby maintaining the image quality.

On the other hand, in the closed-loop control, an image of a predetermined image patch is developed on a photoconductive unit in a state other than the time of image forming operation, and the patch density of the developed or transferred image is detected by a reflectance sensor, transmittance sensor or the like provided near the photoconductive unit or transfer target unit. On the basis of the detected density signal, the process conditions and the like are changed.

The stabilization of the gradation reproducibility and the reproducibility of a thin line or micro-point by such open-loop control or closed-loop control is broadly employed. Such control is generally called "image quality maintenance control".

In a process in a typical electrophotographic apparatus, after a photoconductor such as a photoconductive unit is uniformly charged, light having intensity corresponding to the density of an image to be developed is cast onto the photoconductive unit, and the potential on the surface of the photoconductive unit is attenuated by optical attenuation, thus producing an electrostatic latent image. A laser diode or LED is used as means for casting light to the photoconductive unit, that is, exposure means.

In the image quality maintenance control, the quantity of exposure (exposure power or exposure energy density) of the laser diode, LED or the like is controlled in many cases.

Generally, if exposure is performed with a quantity of exposure that is twice to four times the half-potential exposure quantity of the photoconductive unit (the quantity of exposure required for attenuating the potential of a charged photoconductive unit to half), the potential of the photoconductive unit is attenuated almost completely and reaches a saturated attenuation state where the potential of the photoconductive unit hardly changes even if the quantity of exposure slightly varies. Therefore, if exposure is performed with the quantity of exposure that is twice to four times the half-potential exposure quantity, a stable potential of the photoconductive unit is provided in an area where pixels are not isolated points but are continuous (hereinafter referred to as solid area in some cases).

Utilizing this phenomenon, first, the charging potential of the photoconductive unit and the development bias are adjusted, and the difference between the development bias and the potent of the solid area (that is, development contrast) is adjusted, thereby deciding the density of the solid area.

Next, the gradation reproducibility is adjusted. For adjusting the gradation reproducibility, a method of controlling the exposure power of the laser diode, LED or the like, or a method of changing the type of halftone pattern is used. Other than these, there is a method of fine-tuning the charging potential of the photoconductive unit to adjust the gradation reproducibility.

As such image quality maintenance control, for example, JP-A-03-271763 discloses an image quality maintenance control method in which after a combination of grid potential of a charger and development bias potential is changed to adjust the maximum density of a solid area, the quantity of exposure is controlled on the basis of gradation correction data corresponding to that combination.

JP-A-06-83149 discloses an image quality maintenance method in which after the surface potential is controlled on the basis of a high-density pattern detection value, the quantity of exposure is controlled with a low-density pattern.

Also, JP-A-2006-11171 discloses a technique in which the number of image patches to be formed on an image carrier is reduced to one for image quality maintenance control. In this technique, two or more tables are provided in advance on the apparatus side, then the density of one image patch having an intermediate gradation level is detected, and adjustment of the development bias potential for adjustment of the density of a solid area is determined from the detected image patch density value and the tables. Next, the quantity of exposure is determined and adjusted from the same image patch density value and the tables provided in advance, and the halftone density and gradation reproducibility are adjusted.

In all of these techniques, it is assumed that intense exposure of the photoconductive unit is set with respect to the density of the solid area (saturated attenuation is done to set a stable area), and it can be said that these techniques are robust processes in terms of stabilization of the image. Therefore, image quality maintenance control can be realized by a relatively simple method.

However, not only higher image quality but also higher process speed is demanded of the recent image forming apparatuses.

A higher process speed can be realized by increasing the exposure power and securing exposure energy per unit area. However, high-output lasers or LEDs are costly, and particularly the high-output LEDs have a problem of heat generation or the like and they end up increasing in size. As for the laser diodes, the output is limited when they are arrayed in order to raise resolution.

Thus, a technique for forming an image of high image quality at a high speed while restraining the quantity of exposure (exposure power) is demanded. A technique for forming an image of high image quality with a small quantity of exposure, for example, a quantity of exposure equal to or less than twice the half-potential exposure quantity, instead of the intense exposure as in the conventional technique (the quantity of exposure set to be approximately twice to four times the half-potential exposure quantity of the photoconductive unit as described above), is necessary.

If the quantity of exposure (exposure power) is small, even when exposure is performed, the surface potential of the photoconductive unit is not sufficiently attenuated and it takes an intermediate potential state instead of a saturated potential state. Therefore, if the quantity of exposure changes, the potential of the solid area sensitively changes, too, and becomes unstable in a sense.

On the other hand, a method of realizing the adjustment of the development contrast potential by changing the quantity of exposure, utilizing the characteristic that the potential of the solid area sensitively changes, is known.

However, as a problem in setting such an intermediate potential, deterioration in the reproducibility of a thin line or micro-point, compared with the case of intense exposure, is considered, which is due to the sensitivity of the set potential to the quantity of exposure. This is for the following reasons.

In an ordinary exposure process, a scanning-type optical system is used in view of the speed, cost and the like. For example, a laser beam is caused to scan in the main scanning direction by using a polygon mirror, and a laser beam is caused to scan in the sub-scanning direction while a photoconductive unit is rotated. In the case where an LED line head is used, scanning in the sub-scanning direction is performed while a photoconductive unit is rotated, though beam scanning in the main scanning direction is not necessary. In such a scanning-type optical system, it is difficult to realize an ideal rectangular shape of exposure beam, and the beam has a shape that spreads to a certain extent such as Gaussian beam.

With such a spreading exposure beam shape, the exposure energy spreads and disperses in the direction of beam width. Therefore, particularly when a micro-point or thin line is to be printed, the peak value of the exposure energy is reduced and the potential of the photoconductive unit is not attenuated to a desired potential.

Meanwhile, if a solid area is exposed with a spreading exposure beam shape, the exposure energy of a substantially central part of the beam overlaps between neighboring pixels. Therefore, the potential of the photoconductive unit is largely attenuated, compared with the case of printing an isolated point such as micro-point or thin line. Thus, a large difference is generated between the potential of the photoconductive unit at the micro-point or thin line and the potential of the photoconductive unit in the solid area.

As a result, instability occurs such that if one tries to reproduce the thin line or micro-point sharply, the density of the solid area will become extremely high, whereas if one tries to adjust the density of the solid area to an appropriate level, the thin line or micro-point will be indistinct.

Moreover, if the reproduction of the thin line or micro-point is unstable, also the reproducibility of halftone and gradation tends to be more unstable than in the conventional case where the quantity of exposure is set at a large value. In the conventional image quality maintenance control method, it is difficult to provide sufficient stability.

SUMMARY OF THE INVENTION

In view of the foregoing circumstances, it is an object of this invention to provide an image forming apparatus and image forming method that enables appropriate and stable setting of the density of a micro-point or thin line and the density of a solid area while setting the quantity of exposure at a low level.

In order to achieve the above object, an image forming apparatus according to an aspect of this invention includes: a photoconductive unit; an exposure unit configured to output a pulse-width-modulated light signal and expose the photoconductive unit; a developing unit configured to develop the photoconductive unit and form a developed image on the photoconductive unit; a transfer unit configured to transfer the developed image to a transfer target unit and form a transferred image; an image patch generating unit configured to generate an image patch formed by a predetermined pattern; a sensor unit configured to detect density information of the developed image of the image patch formed on the photoconductive unit or the transferred image of the image patch formed on the transfer target unit; and an image quality maintenance control unit configured to decide a proper quantity of exposure and a proper pulse width on the basis of the density information detected by the sensor unit and set the decided proper quantity of exposure and the proper pulse width in the exposure unit.

Also, in order to achieve the above object, an image forming method according to an aspect of this invention is adapted for an image forming apparatus including a photoconductive unit, an exposure unit configured to output a pulse-width-modulated light signal and expose the photoconductive unit, a developing unit configured to develop the photoconductive unit and form a developed image on the photoconductive unit, and a transfer unit configured to transfer the developed image to a transfer target unit and form a transferred image. The image forming method includes: generating an image patch formed by a predetermined pattern; detecting density information of the developed image of the image patch formed on the photoconductive unit or the transferred image of the image patch formed on the transfer target unit; deciding a proper quantity of exposure and a proper pulse width on the basis of the detected density information; and setting the decided proper quantity of exposure and the proper pulse width in the exposure unit.

BRIEF DESCRIPTION OF THE DRAWINGS

In the attached drawings,

FIG. 21 is a table showing the results of comparative tests.

DETAILED DESCRIPTION OF THE PREFERRED EMBODIMENTS

Embodiments of an image forming apparatus and image forming method according to this invention will be described with reference to the attached drawings.

(1) Configuration of Image Forming Apparatus

Figure 1:
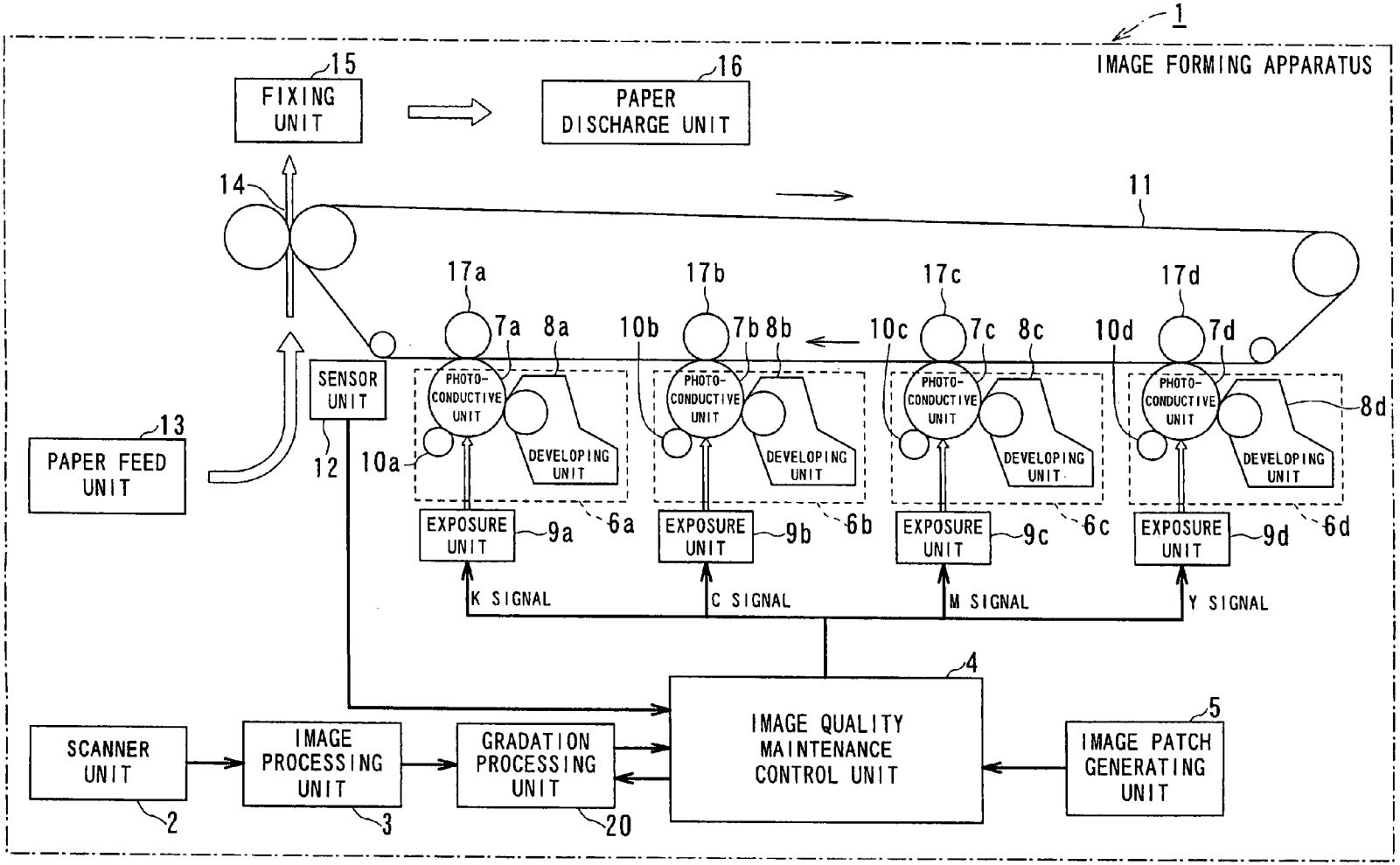
FIG. 1 is a view showing an exemplary overall configuration of an image forming apparatus according to an embodiment of this invention.

FIG. 1 is a view showing an exemplary configuration of an image forming apparatus 1 according to this embodiment. The image forming apparatus 1 is, for example, a tandem color copy machine, as shown in FIG. 1. The image forming apparatus 1 has a scanner unit 2, an image processing unit 3, a gradation processing unit 20, an image quality maintenance control unit 4, an image patch generating unit 5, process cartridges 6*a*, 6*b*, 6*c* and 6*d*, an intermediate transfer belt (transfer target unit) 11, intermediate transfer rollers (transfer unit) 17*a*, 17*b*, 17*c* and 17*d*, a paper feed unit 13, a recording paper transfer unit 14, a fixing unit 15, and a paper discharge unit 16.

The scanner unit 2 reads an original and, for example, generates image data of the three primary colors R, G and B. In the image processing unit 3, color conversion processing from the three primary colors R, G and B to four printing colors K (black), C (cyan), M (magenta) and Y (yellow), and various types of image processing are performed to each image data.

The image-processed K signal, C signal, M signal and Y signal are inputted to the gradation processing unit 20. The gradation processing unit 20 has a set of intermediate gradation patterns that represent densities of intermediate gradation levels, and a density conversion table (gradation curve) that associates the densities of intermediate gradation levels with the intermediate gradation patterns. The gradation processing unit selects one of the intermediate gradation patterns in the density conversion table in accordance with the density (number of gradation levels) of inputted image data.

The selected intermediate gradation pattern is inputted to the process cartridges 6*a*, 6*b*, 6*c* and 6*d* via the image quality maintenance control unit 4. The operation of the image quality maintenance control unit 4 is related to a main point of this invention and will be later described in detail.

The process cartridges 6*a*, 6*b*, 6*c* and 6*d* correspond to the four colors for color printing. These are formed by four process cartridges for K signal, C signal, M signal and Y signal and constructed to be attachable to and removed from the image forming apparatus 1. All of the respective process cartridges 6*a*, 6*b*, 6*c* and 6*d* have basically the same configuration though the toner stored in their developing units 8*a*, 8*b*, 8*c* and 8*d* differs. Thus, in the following description of the process cartridges, the suffixes a, b, c and d to the numerals will be omitted.

The process cartridge 6 has a photoconductive unit 7, a developing unit 8, and a charger 10. The surface of the photoconductive unit 7 is charged to a predetermined potential by the charger 10, and an electrostatic latent image is formed on the surface by light cast from an exposure unit 9, for example, laser beam. The electrostatic latent image is developed with toner supplied from the developing unit 8, and a developed image corresponding to each toner color is formed on the surface of the photoconductive unit 7.

The developed image formed on the photoconductive unit 7 is superimposed and transferred onto the intermediate transfer belt 11 in the order of Y, M, C and K. When the photoconductive unit 7*a* for K is passed, a full-color toner image in which the four colors are combined is formed on the intermediate transfer belt 11.

The density (or reflectance) of this toner image is detected by the sensor unit 12 and used for image quality maintenance control processing, which will be described later.

In the recording paper transfer unit 14, the toner image on the intermediate transfer belt 11 is transferred to a recording paper supplied from the paper feed unit 13. The toner image transferred to the recording paper is fixed to the recording paper by the fixing unit 15, and the recording paper is discharged to outside from the paper discharge unit 16.

(2) Toner Image Forming Process

In the process cartridge 6, a toner image is formed on the surface of the photoconductive unit 7. In view of the quality of the image, the density of the toner image is very important. Hereinafter, a mechanism by which the density of the toner image is decided, and its adjusting method will be described.

The charging bias, development bias, quantity of exposure and the like of the photoconductive unit at the start of the operation are decided in accordance with a table incorporated in the image forming apparatus 1 in advance, which is referred to as open control. This is adapted for predicting changes in the charging quantity of the toner and changes in the characteristics of various materials and changing the various preset values, mainly on the basis of the values of a temperature/humidity sensor provided within the apparatus, a rotation history counter of the photoconductive drum (photoconductive unit 7), a counter of the developing unit 8 and the like.

For the toner image forming process according to this embodiment, the following specific values are assumed.

For example, the photoconductive unit 7 is an organic multilayered photoconductive unit to be charged to negative polarity. The charger 10 uses a contact charging roller, and an AC voltage having a peak-to-peak value ACpp of 3 kV is superimposed on a DC voltage of −800 V at a frequency of 2 kHz. As a result, the surface of the photoconductive unit 7 is charged substantially uniformly to approximately −780 V.

For the developing unit 8, a two-component developing unit with a mixture of toner and carrier is used. A developing roller is a sandblasted mag roller and is arranged closely to the photoconductive unit with a gap of 100 to 800 μm. A brush of a carrier is formed on the mag roller, and the toner carried onto the mag roller by the carrier is developed from there onto the photoconductive unit 7. As the development bias, an appropriate AC bias is superimposed on a DC voltage of approximately −650 V. A certain measure to secure a sufficient development density is typically taken, such as preventing attachment of the carrier to the photoconductive unit 7 or reducing fog by making the AC waveform rectangular or changing the duty ratio. Now, as the half-potential exposure quantity of the photoconductive unit, 0.15 nJ/cm2 is used. In this case, for example, if light of 0.2 nJ/cm2 is cast, the potential of the photoconductive unit is attenuated to approximately −280 V. Also, the development contrast potential (difference between the potential of the photoconductive unit 7 after exposure and the development bias potential) is −370 V.

Here, the preset of 0.2 nJ/cm2 as the quantity of exposure is approximately 1.3 times the half-potential exposure quantity of 0.15 nJ/cm2. In terms of the quantity of exposure versus potential characteristic, the setting is in a range where the potential changes significantly with the change in the quantity of exposure.

In this state, for example, if the quantity of charging of the toner is approximately −30 μC/g, the development contrast is too high and excessive toner is developed. The density D of the solid area becomes close to 1.7. The density D is a quantity defined by D=log(1/R), where R represents the reflectance of the toner image.

If the quantity of attached toner is large, the toner consumption increases. This not only increases the printing cost but also causes burden on the fixing unit 15. Therefore, image defects such as fixing failure occur.

On the other hand, for example, when a micro-point is printed, the exposure energy disperses in the direction of width of the exposure beam, as described above, and the potential of the photoconductive unit 7 is not sufficiently attenuated.

FIG. 2 and FIG. 3 are views illustrating how the potential of the photoconductive unit 7 after exposure changes at a micro-point and in a solid area.

Figure 2B:
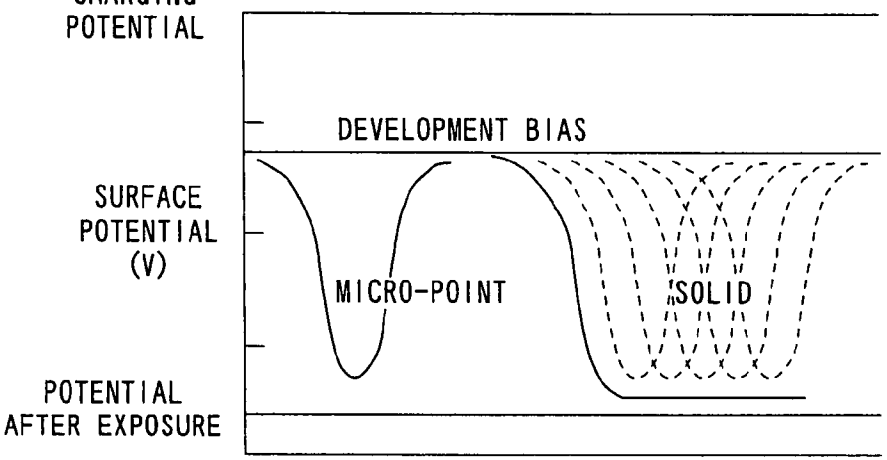
FIG. 2A and FIG. 2B are views showing the relation between the photoconductive unit potentials of a micro-point and a solid area in a case where the quantity of exposure is set at a large value.
Figure 2A:
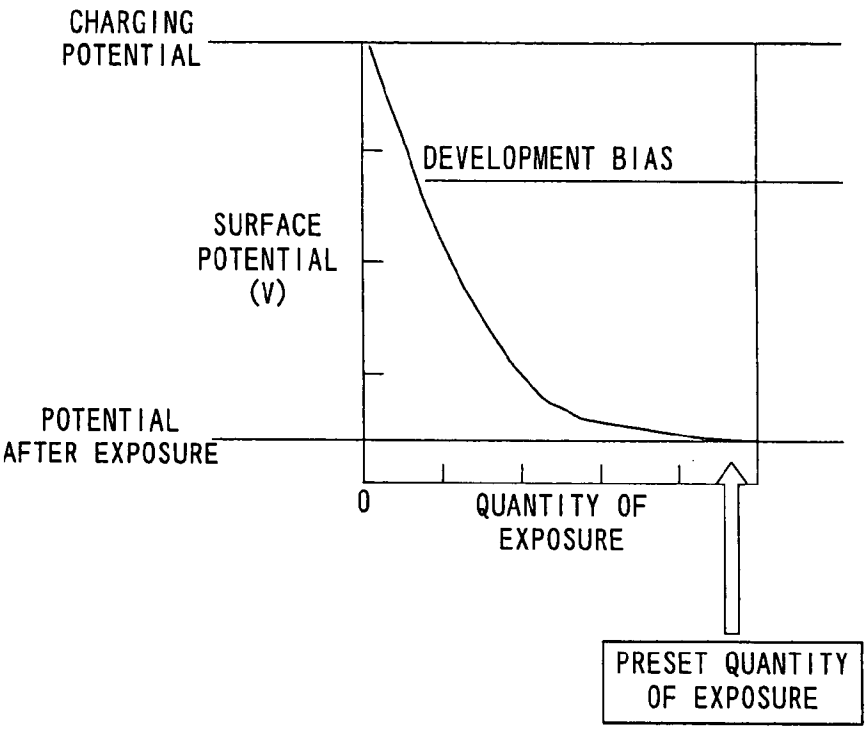

FIG. 2A and FIG. 2B show the surface potential characteristics of the photoconductive unit in the case where the quantity of exposure (for example, the power of laser beam) is large. As shown in FIG. 2A, when the preset quantity of exposure is large (for example, twice to four times the half-potential exposure quantity), the potential of the photoconductive unit 7 is almost fully attenuated and falls within a range of saturated attenuation. Therefore, as shown in FIG. 2B, even in the solid area (where many micro-points overlap each other continuously), the potential is not largely different from the potential at a micro-point.

Figure 3B:
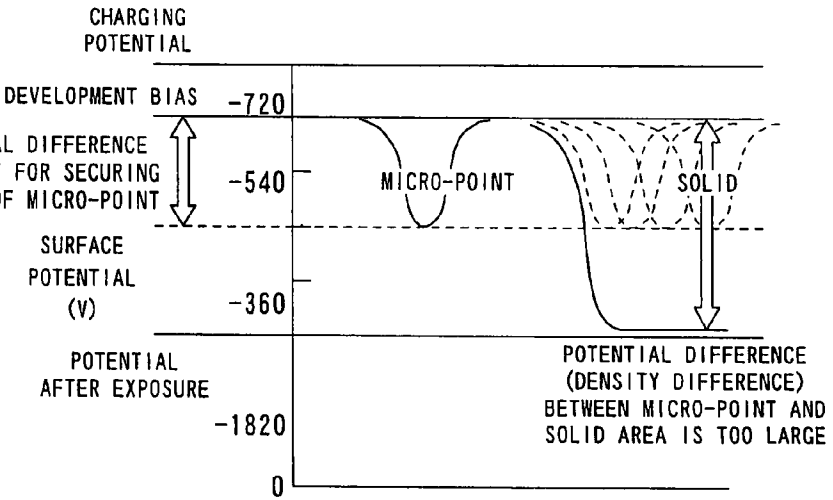
FIG. 3A and FIG. 3B are views showing the relation between the photoconductive unit potentials of a micro-point and a solid area in a case where the quantity of exposure is set at a small value.
Figure 3A:
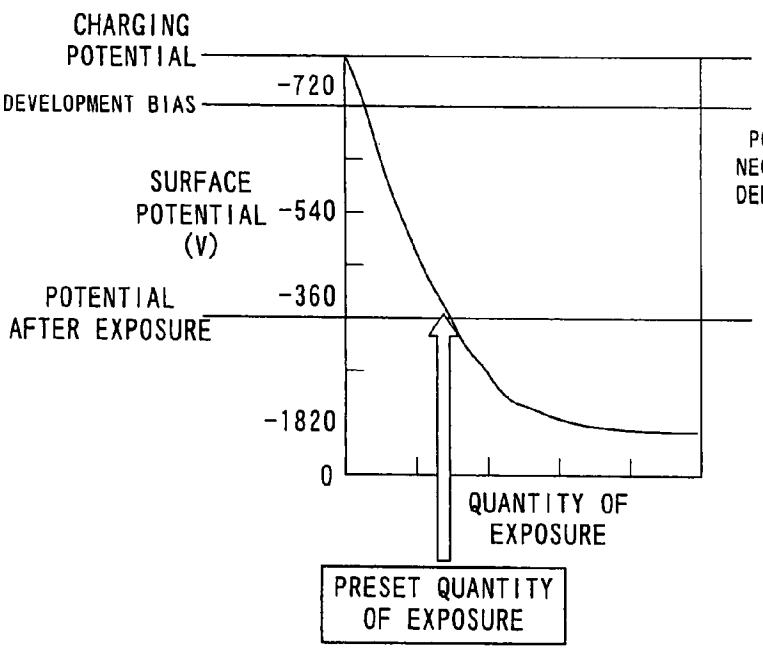

On the contrary, FIG. 3A and FIG. 3B show the surface potential characteristics of the photoconductive unit in the case where the quantity of exposure is relatively small (for example, twice the half-potential exposure quantity or less). As shown in FIG. 3A, when the preset quantity of exposure is small, the potential of the photoconductive unit 7 does not reach the saturated attenuation range and will be set in a sloped intermediate range. As a result, as shown in FIG. 3B, in the solid area, the continuous overlapping of many micro-points significantly lowers the potential, and a large potential difference is generated between the solid area and an isolated micro-point.

The potential difference between the solid area and the micro-point becomes more conspicuous as the diameter of exposure beam increases. This is because if the diameter of the exposure beam increases, the peak power of the beam decreases and the potential at the micro-point cannot be sufficiently lowered. As a result, the reproducibility of the micro-point is deteriorated.

Figure 4:
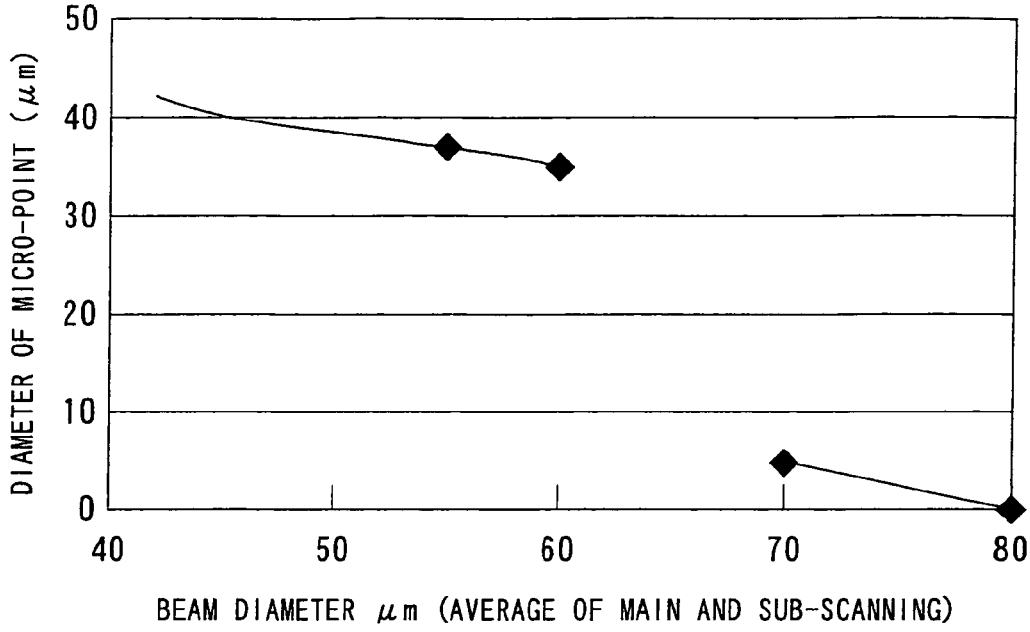
FIG. 4 is a view showing an exemplary relation between the reproducibility of a micro-point and the exposure beam diameter.

FIG. 4 shows the result of testing the reproducibility of a micro-point when the diameter of the exposure beam is changed.

The development contrast potential was set at −280 V so that the quantity of attached toner in the solid area would be 0.6 mg/cm2 or less, where the surface potential of the photoconductive unit was set at −780 V and the DC component of the development bias was set at −650 V. The result of observing whether stable reproduction of a micro-point (a micro-point having a diameter of approximately 42 μm and equivalent to one dot size for the resolution of 600 dpi) is possible or not, while changing the diameter of the exposure beam, is shown.

The measured value is an average diameter in the case where 20 micro-points were printed. The beam diameter was adjusted to substantially the same beam diameter in both the main scanning direction and the sub-scanning direction, but practically the beam diameters in the main and sub-scanning directions were averaged. In an area where the diameter of the exposure beam is 70 μm or larger, the micro-points are extremely smaller than the original diameter of approximately 42 μm.

The reason is as follows. If the quantity of attached toner (density) in the solid area is constant, as the beam diameter increases, the potential at the micro-points is not sufficiently lowered and the density of the micro-points is lowered. Therefore, a phenomenon occurs such that the micro-points cannot be reproduced (the image of the micro-points is not formed). When an average value is calculated, it appears like reduction in the diameter.

However, in this case, it is considered that the micro-point size demanded of the apparatus is one dot size at 600 dpi. If the resolution of the apparatus changes to, for example, 1200 dpi or 2400 dpi, and in some cases, actual printing is carried out up to this scale depending on the signal, it is obvious that even a beam diameter of 60 μm or less is not enough. If the performance to print micro-points, for example, at 1200 dpi, is necessary, it is considered desirable that the beam diameter is 35 μm or less.

Figure 5:
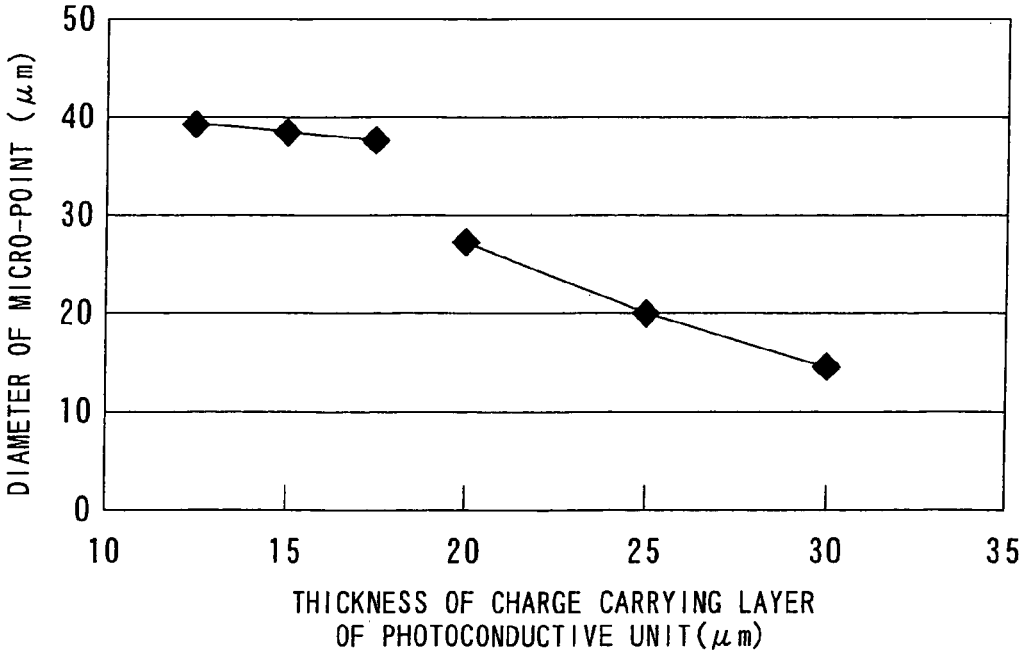
FIG. 5 is a view showing an exemplary relation between the reproducibility of a micro-point and the thickness of a charge carrying layer of a photoconductive unit.

FIG. 5 shows the result of testing in the case where the thickness of the charge carrying layer of the photoconductive unit 7 was changed. When the thickness of the charge carrying layer in the multilayered photoconductive unit is increased, the diffusion of charges after exposure increases, having a similar effect of increasing the beam diameter in a sense. Usually, the thickness of the charge carrying layer is known to be approximately 15 to 25 μm. However, if the resolution is to be increased, the thickness must be reduced, whereas if the sensitivity or the service life is to be increased, it is advantageous to increase the thickness.

FIG. 5 shows the result of testing with a beam diameter of 55 μm. The diameter of a micro-point that is one dot at 600 dpi has no problem if the thickness of the charge carrying layer is approximately 17 μm. However, it can be seen that with a thickness of 20 μm or more, the reproduction of the micro-point quickly deteriorates.

As described above, setting the quantity of exposure at a low level (twice the half-potential exposure quantity or less) is advantageous in view of power consumption and miniaturization of the exposure device such as a semiconductor laser, but the difference in the potential of the photoconductive unit after exposure between a micro-point or thin line (hereinafter referred to as micro-point or the like) and a solid area increases (see FIG. 3). As a result, the difference in the density of the image between the micro-point or the like and the solid area increases, making it difficult to set both of them at a proper density.

This phenomenon will be conspicuous particularly when the diameter of the exposure beam is relatively large or when the thickness of the charge carrying layer of the photoconductive unit is large.

The main point of this invention is in providing an image quality maintenance and adjusting method that enables adjustment of both the density of the micro-point or the like and the density of the solid area to a proper value, in the image quality maintenance control to correct changes in the characteristics of the electronic materials (toner, photoconductive unit and the like) due to environmental changes and secular changes.

(3) Image Quality Maintenance Control Method (First Embodiment)

Figure 6:
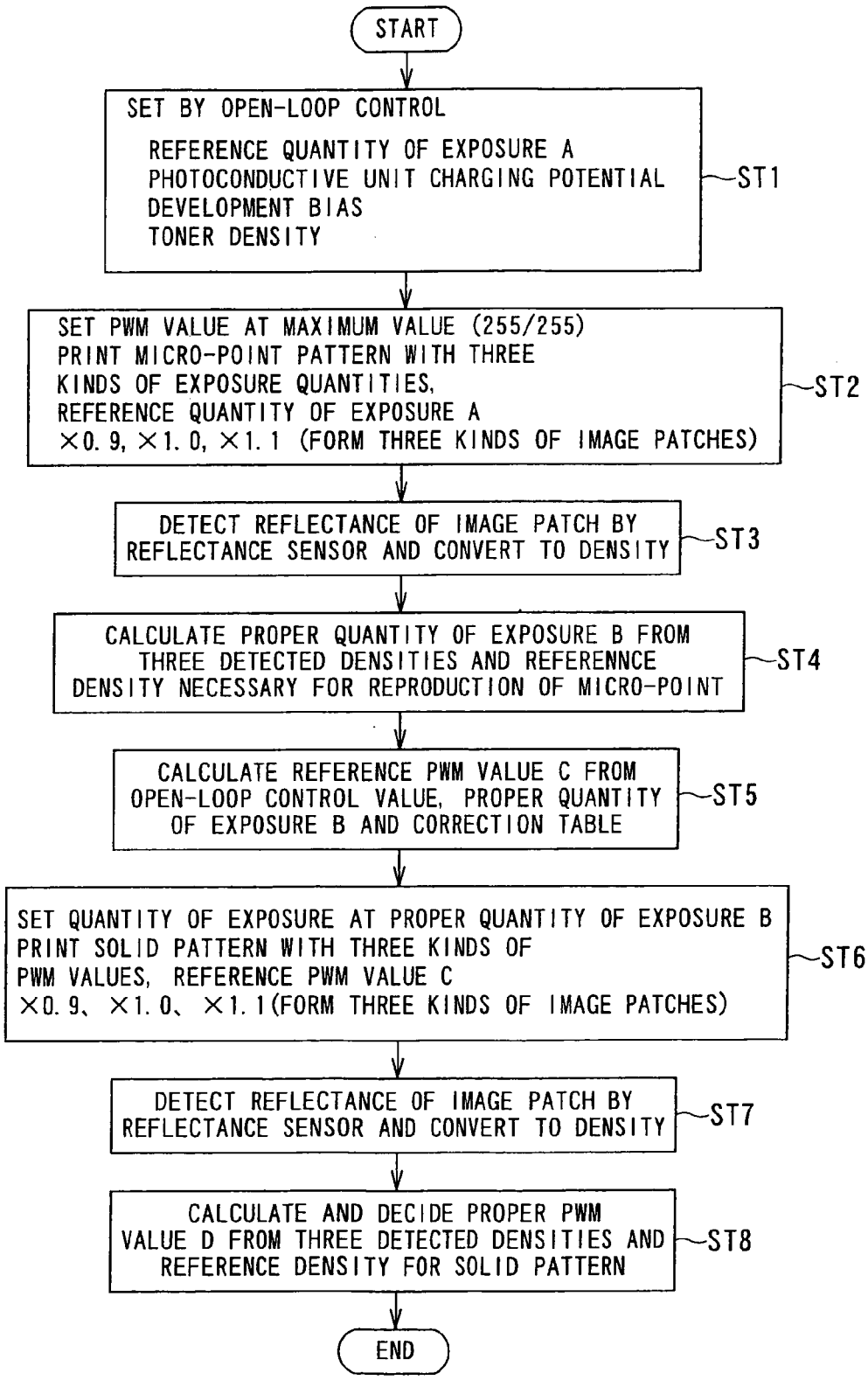
FIG. 6 is a flowchart showing an example of processing in an image quality maintenance control method according to a first embodiment.

FIG. 6 is a flowchart showing an example of processing in an image quality maintenance control method according to a first embodiment.

First, in step ST1, a reference quantity of exposure A, photoconductive unit charging potential, development bias, and toner density are set by so-called open-loop control.

These initial values in the process are adjusted to proper values in an adjustment stage in manufacturing. However, as described above, the characteristics of the electronic materials change because of environmental changes and secular changes. To compensate for these changes in the characteristics, the initial values in the process are first corrected by open-loop control.

Specifically, for example, the image forming apparatus 1 is provided with a correction coefficient table in which the adjustment stage in manufacturing has a reference value "1", and the foregoing initial values in the process are multiplied by this correction coefficient and thus corrected.

Figure 7A:
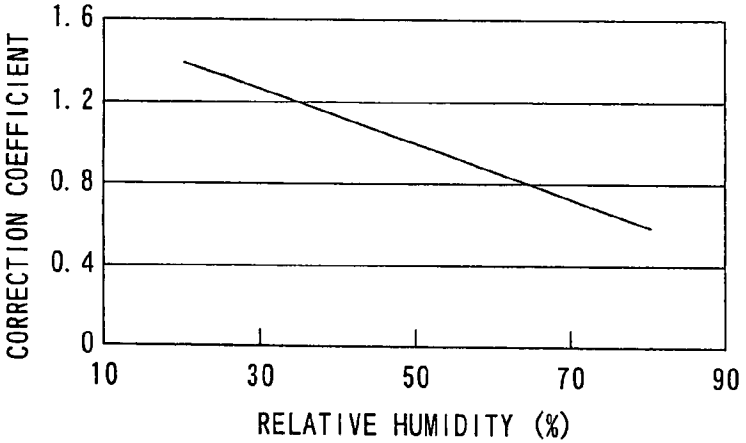
FIGS. 7A to 7C are views showing exemplary correction coefficients used for open-loop control.
Figure 7B:
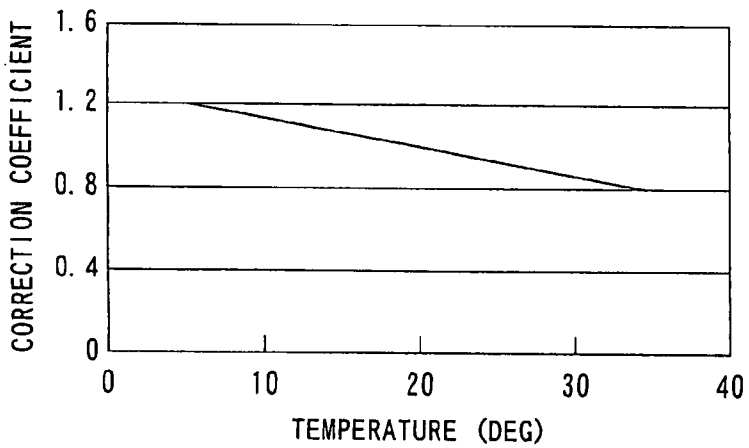
Figure 7C:
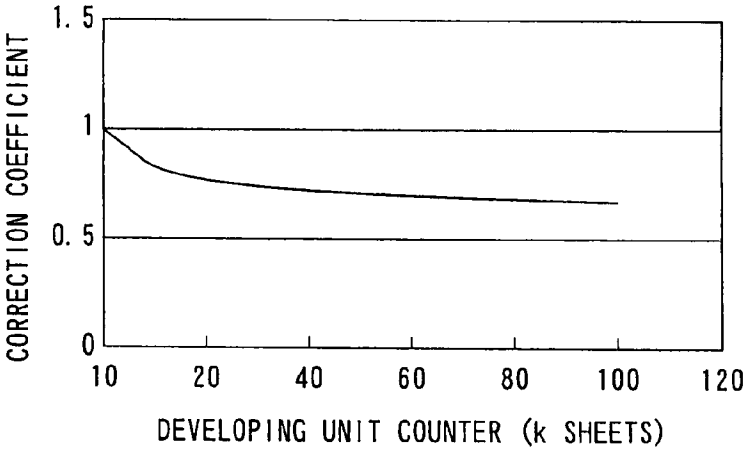

FIG. 7A and FIG. 7B are graphs showing examples of correction coefficients in the case where the relative humidity and temperature at the time of adjustment in manufacturing are set at a reference value "1". FIG. 7C shows an example in which the elapsed time is counted by the number of developed recording papers, thus determining a correction coefficient.

In the first embodiment, the photoconductive unit charging potential, development bias and toner density set by open-loop control are fixed, and then the quantity of exposure and a PWM value (pulse width) are decided so that both the density of the micro-point or the like and the density of the solid area take proper values.

The quantity of exposure is prescribed by the energy per unit area, of a laser beam or the like. It may also be prescribed by laser power. The PWM value may be prescribed by the absolute value of pulse width in performing pulse-width modulation of a laser beam or the like, or may be prescribed by the ratio to a maximum pulse width. If the pulse width per pixel is expressed by 8 bits, the maximum pulse width that allows the total area of one pixel to be on is 255. If the ratio to the maximum pulse width is prescribed by the PWM value, the PWM value is expressed, for example, by the notation of PWM(n/255) (n=0 to 255).

Steps ST2 to ST4 are the steps to decide a proper quantity of exposure to the micro-point. In this embodiment, in setting the density of the micro-point, the PWM value is set at the maximum PWM (255/255) and the density of the micro-point is set only by the setting of the quantity of exposure.

Therefore, in step ST2, first, the PWM value is set at PWM (255/255). Next an image patch (first image patch) formed by a micro-point pattern (first pattern) is printed, for example, with three kinds of exposure quantities.

Figure 8:
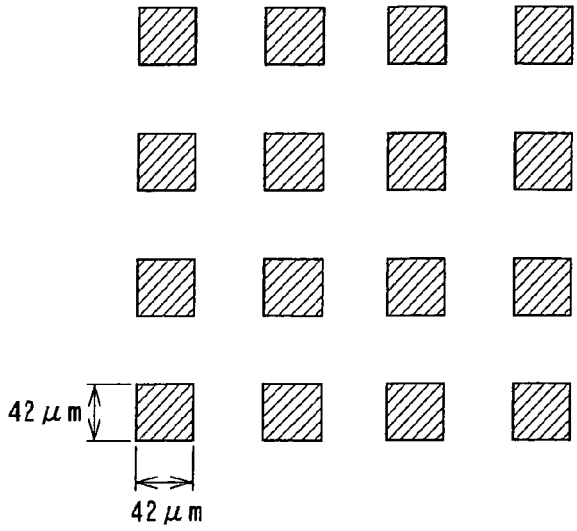
FIG. 8 is a view showing an exemplary pattern of micro-points.

This micro-point pattern is a reference pattern for deciding the density of the micro-point and is generated by the image patch generating unit 5 (see FIG. 1). FIG. 8 shows an example thereof.

In the example shown in FIG. 8, the micro-point pattern is a pattern in which pixels are arranged vertically and horizontally with a predetermined spacing, each pixel being a square approximately 42 μm on each side, which is the size of one pixel at the resolution of 600 dpi.

This pattern is printed with three different kinds of exposure quantities, and three toner image patches having different densities are formed on the intermediate transfer belt 11. The quantities of exposure in this case are, for example, the reference quantity of exposure A set in step ST1 and densities higher and lower than this by one point. For example, printing is performed with the three kinds of exposure quantities, that is, reference quantity of exposure A×0.9, reference quantity of exposure A×1.0, and reference quantity of exposure A×1.1.

In step ST3, the densities of the three image patches formed on the intermediate transfer belt 11 are detected by the sensor unit 12. Alternatively, the reflectance is measured and the reflectance may be converted to density.

Next, in step ST4, a quantity of exposure to be a reference density, that is, a proper quantity of exposure, is calculated and decided from a preset reference density (first reference density) for the micro-point pattern and the detected three densities.

Figure 9:
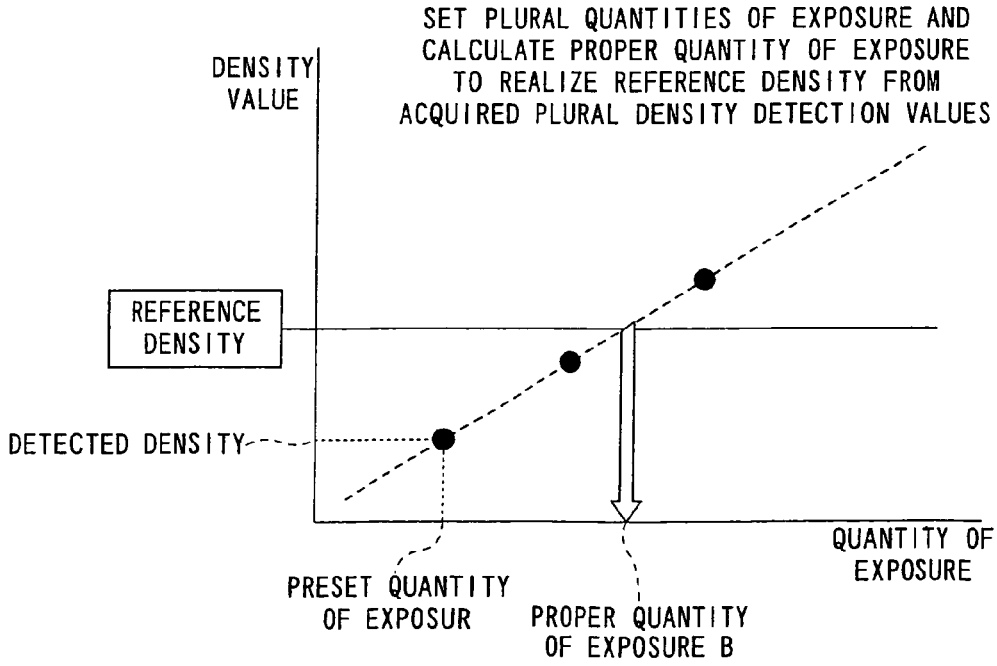
FIG. 9 is a view for explaining a method for deciding a proper quantity of exposure in the first embodiment.

FIG. 9 is a view for explaining the concept of a method for calculating and deciding a proper quantity of exposure. In FIG. 9, the three filled dots represent the detected densities. From the three detected densities, the actual relation of quantity of exposure verses density in the current environment and elapsed time is found by, for example, a linear regression method, and a proper quantity of exposure B for the reference density can be decided.

By this stage, the proper quantity of exposure B for printing the micro-point with a proper density has been decided.

Steps ST5 to ST8 are the steps to decide the density of the solid area so that it takes a proper value. For the density of the solid area, the quantity of exposure is fixed to the proper quantity of exposure B and then the PWM value is set at a proper value so that the density of the solid area will be a reference density (second reference density).

In step ST5, a reference PWM value C is calculated from the open-loop control values (photoconductive unit charging potential, development bias and toner density) set in step ST1, the proper quantity of exposure B decided in step ST4, and the correction table.

Next, in step ST6, after the quantity of exposure is set at the proper quantity of exposure B, an image patch (second image patch) of a high-density pattern (second pattern) is printed with three different PWM values. Here, a high-density pattern is a solid pattern in which pixels continue vertically and horizontally, or a pattern with high density proximate to this solid pattern. It is generated by the image patch generating unit 5. In the following description, a solid pattern is used as an exemplary high-density pattern.

The PWM values to be set are, for example, the reference PWM value C set in step ST5 and PWM values larger and smaller than this by one point. For example, three kinds of PWM values, that is, the reference PWM value C×0.9, the reference PWM value C×1.0, and the reference PWM value× 1.1, are used.

In step ST7, the densities of the image patches printed with the three different PWM values are detected.

Figure 10:
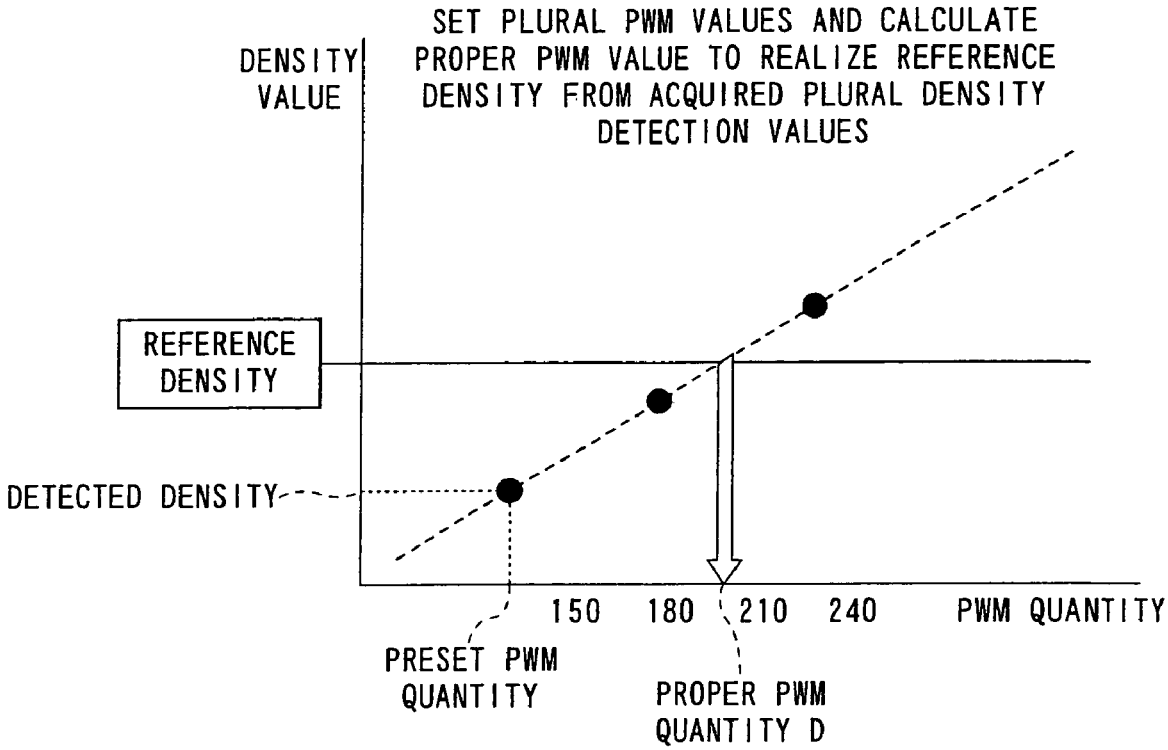
FIG. 10 is a view for explaining a method for deciding a proper PWM value in the first embodiment.

In step ST8, a proper PWM value D is calculated and decided from the reference density for the solid area and the detected three densities, as shown in FIG. 10, by a method similar to the calculation and decision of the proper quantity of exposure B.

Figure 11:
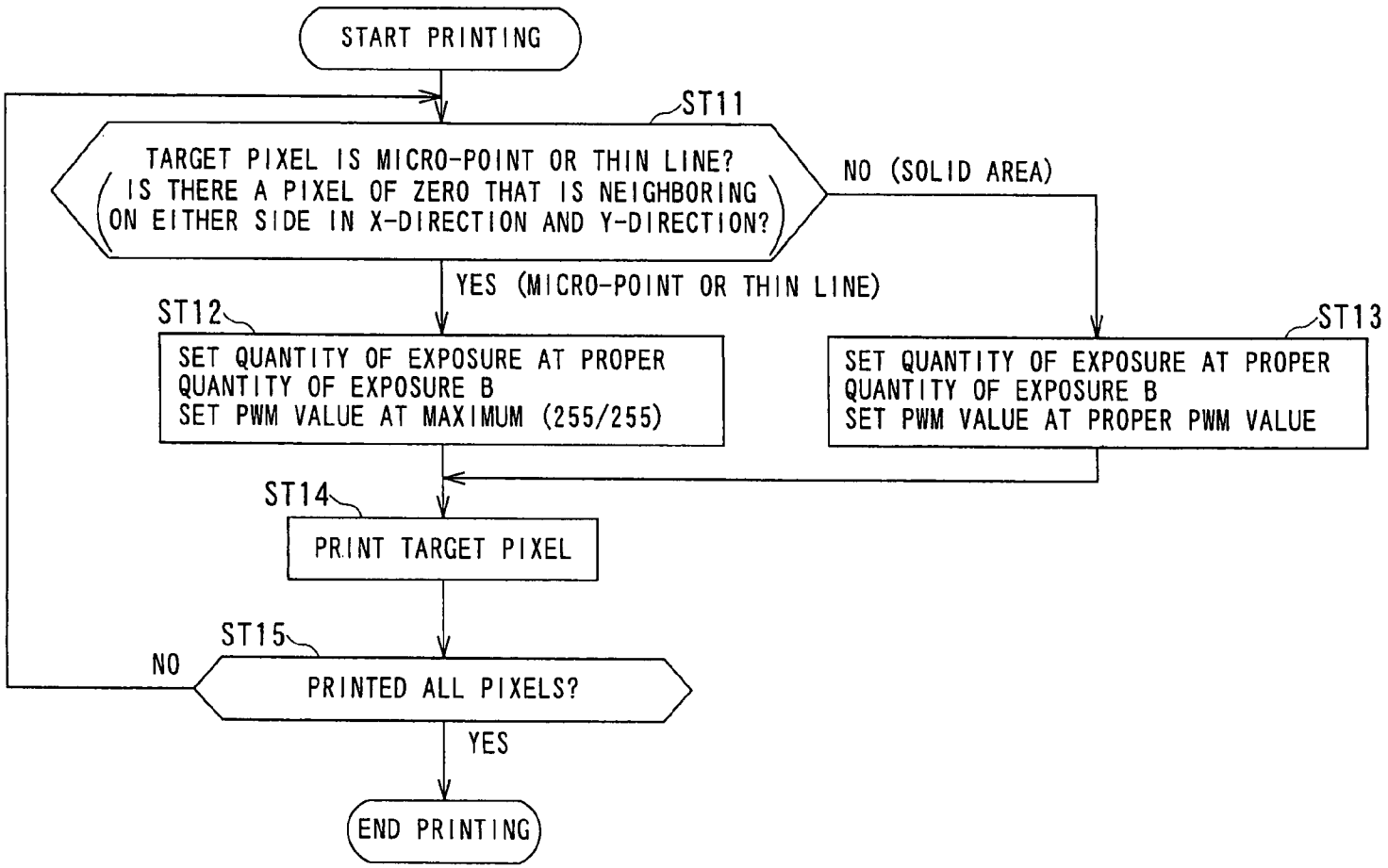
FIG. 11 is a view showing an example of processing to print an image by using the decided proper quantity of exposure and proper PWM value.

The processing for practically printing an image by using the proper quantity of exposure B and the proper PWM value D decided in the above-described manner is shown FIG. 11.

First, in step ST11, it is determined whether a target pixel is a pixel of a micro-point (or thin line) or a pixel of a solid area. For example, if there is at least one pixel of level zero that is next to the target pixel on either side in the X-direction and Y-direction, it is determined that the target pixel is a pixel of a micro-point (or thin line). Otherwise, it is determined that the target pixel is a pixel of a solid area.

For a pixel of a micro-point (or thin line), the quantity of exposure is set at the proper quantity of exposure B and the PWM value is set at the maximum PWM (255/255) (step ST12), and the pixel is thus printed (step ST14).

On the other hand, if it is determined that the target pixel is a pixel of a solid area, the quantity of exposure is set at the proper quantity of exposure B and the PWM value is set at the proper PWM value D (step ST13), and the pixel is printed (step ST14). This processing is carried out with all the pixels (step ST15).

Figure 12:
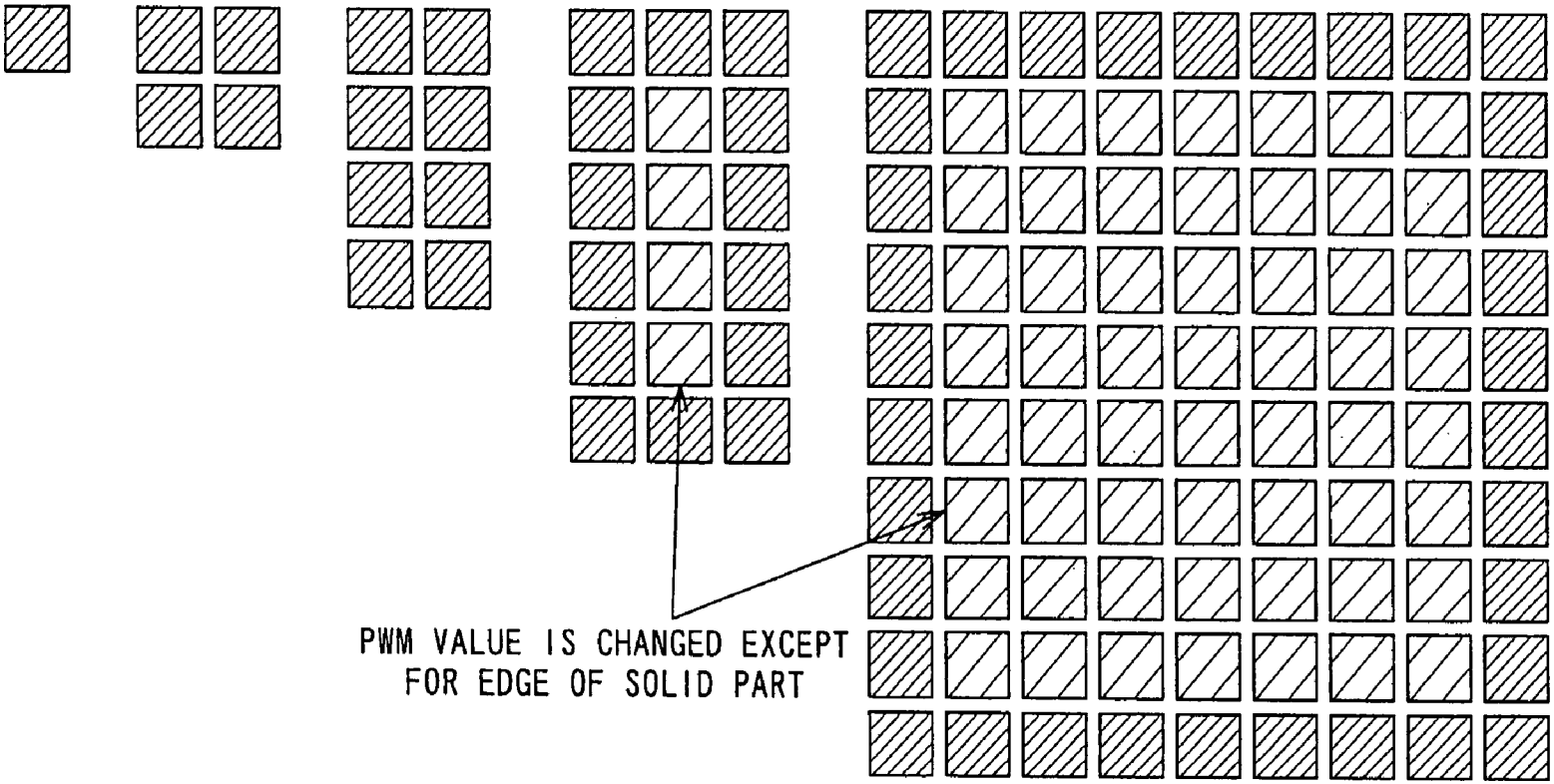
FIG. 12 is a view showing an exemplary printing state of micro-points and a solid area.

FIG. 12 shows an exemplary image printed by using the above processing. The dark-colored pixels are pixels determined to be pixels of the micro-point (or thin line) and they are printed with the proper quantity of exposure B and the maximum PWM (255/255). The light-colored pixels are pixels determined to be pixels of the solid area and they are printed with the proper quantity of exposure B and the proper PWM value D (PWM value smaller than the maximum PWM (255/255), for example, PWM (200/255)).

As a result, the micro-point (or thin line) is sufficiently reproduced at the reference density for micro-point, and the density is printed to meet the reference density for solid area, without having an excessively high density.

As shown in FIG. 12, according to this method, since the density of the outer edge of the solid area is set to be higher than the density of the inner part, there is an effect that a sharp image is formed with the contour of the solid area emphasized.

(4) Image Quality Maintenance Control Method (Second Embodiment)

An image quality maintenance control method according to a second embodiment is a simplified version of the method of the first embodiment (flowchart shown in FIG. 6).

In the first embodiment, the two printing steps are used, that is, first, printing an image patch for micro-point and deciding the proper quantity of exposure B, and then printing an image patch of a solid pattern by using the decided proper quantity of exposure B, thus deciding the proper PWM value D.

Also, in the two respective printing steps, the processing to set the quantity of exposure and the PWM value at plural different values and then decide the proper quantity of exposure B and the proper PWM value D from the acquired plural densities is performed.

On the other hand, in the second embodiment, an image patch for a micro-point and an image patch of a solid pattern are printed in a single printing step. The quantity of exposure and the PWM value that are set in this case do not take plural values but one preset value.

Figure 13:
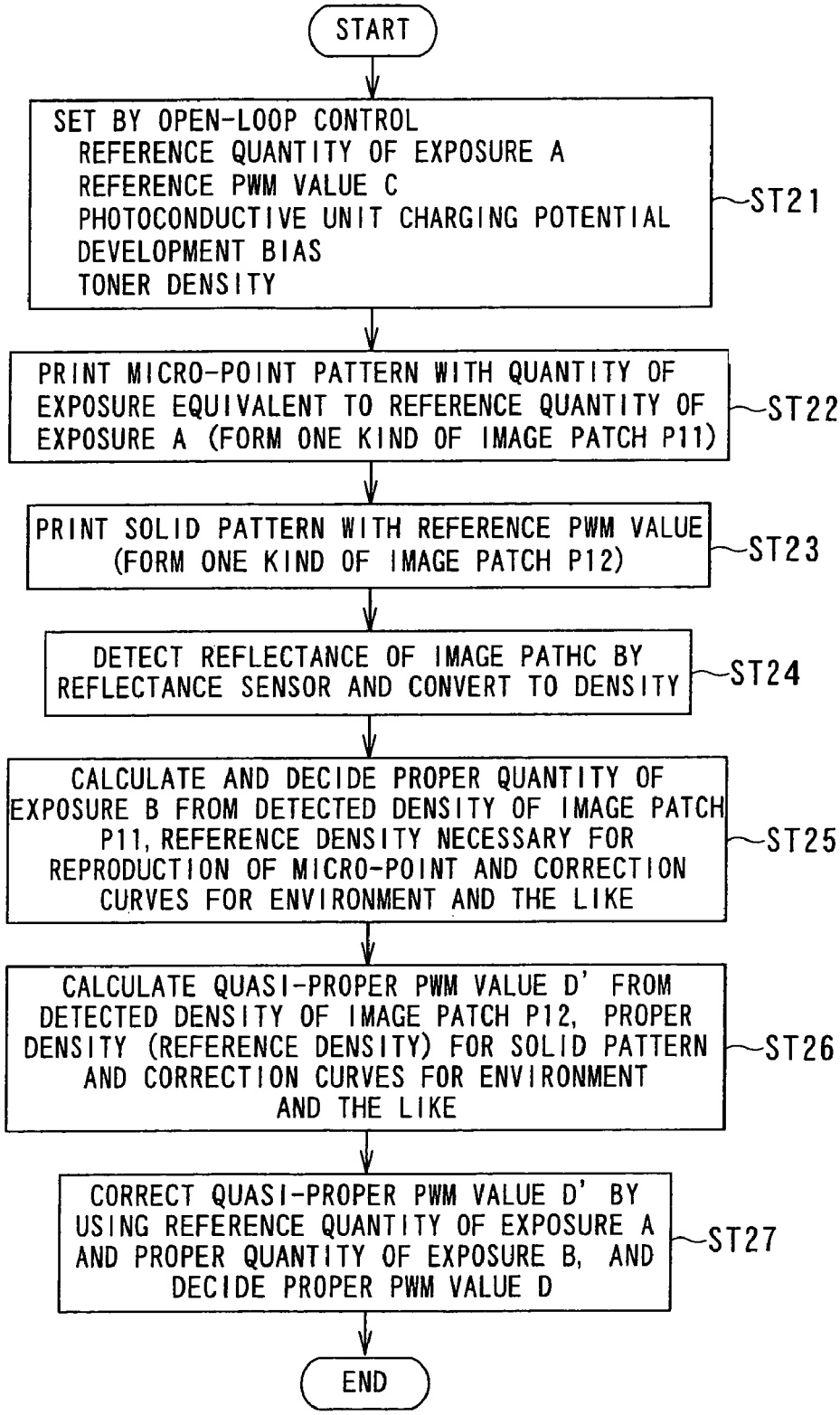
FIG. 13 is a flowchart showing an example of processing in an image quality maintenance control method according to a second embodiment.

FIG. 13 is a flowchart showing an example of processing in the image quality maintenance control method according to the second embodiment.

First, in step ST21, a reference quantity of exposure A, reference PWM value C, photoconductive unit charging potential, development bias, and toner density are set by open-loop control.

Next, using the reference quantity of exposure A set by this open-loop control and the maximum PWM (255/255), the micro-point pattern is printed onto the intermediate transfer belt 11, thus forming an image patch P11 on the intermediate transfer belt 11 (step ST22).

Along with this, using the reference quantity of exposure A and the reference PWM value C set by the open-loop control, the solid pattern is printed onto the intermediate transfer belt 11, thus forming an image patch P12 on the intermediate transfer belt 11 (step ST23).

In step ST24, the densities of the printed image patch P11 and image patch P12 are detected.

In step ST25, a proper quantity of exposure B is calculated and decided from the detected density of the image patch P11, a reference density necessary for reproduction of a micro-point (first reference density), and plural correction curves provided in advance for correcting the environment and time of use.

Figure 14:
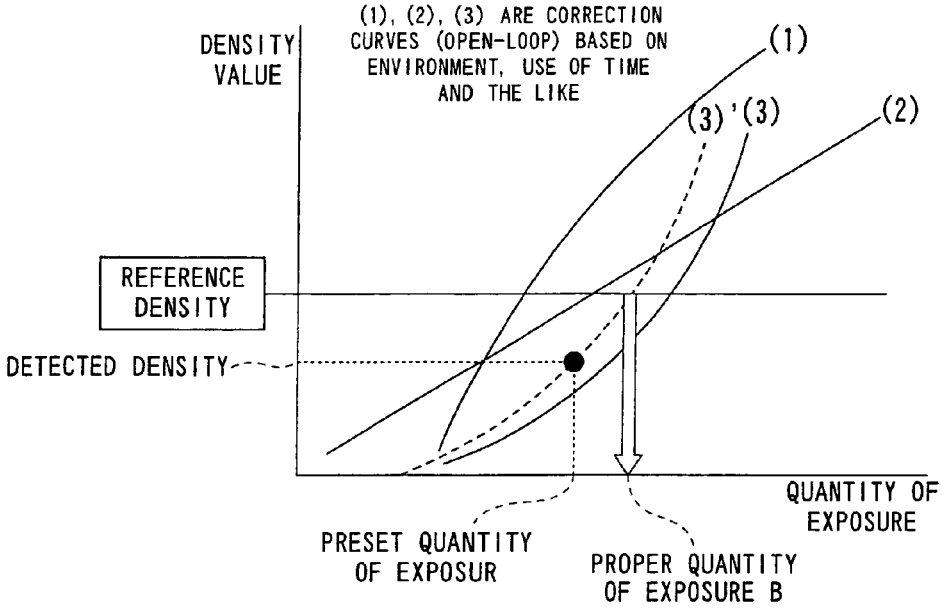
FIG. 14 is a view for explaining a method for deciding a proper quantity of exposure in the second embodiment.

FIG. 14 is a view for explaining the concept of the processing of step ST25. The quantity of exposure verses density characteristic varies depending on the use environment and the time of use. Thus, plural correction curves (correction information) for each use environment and time of use are provided in advance in the image quality maintenance control unit 4 (in the example shown in FIG. 14, three correction curves (1), (2) and (3) are provided). Then, in accordance with a temperature/humidity sensor, a time of use counter and the like, which are separately provided, a correction curve that is closest to the current environment, for example, the correction curve (3), is selected.

Meanwhile, in step ST24, the density for the preset quantity of exposure (in this case, reference quantity of exposure A) is detected (in FIG. 14, this detected density is indicated by a filled dot). Using this detected density, the correction curve that is closest to the current environment, for example, the correction curve (3), is further corrected. For example, the correction curve (3) is shifted so that the correction curve (3) overlaps the filled dot, thus generating a correction curve (3)' (correction curve of broken line). Using this correction curve (3)', the proper quantity of exposure B corresponding to the reference density (first reference density) is decided.

Next, in step ST26, using the detected density of the image patch P12, the reference density for the solid pattern (second reference density) and the correction curves for the environment and time of use, a quasi-proper PWM value D' is calculated.

Figure 15:
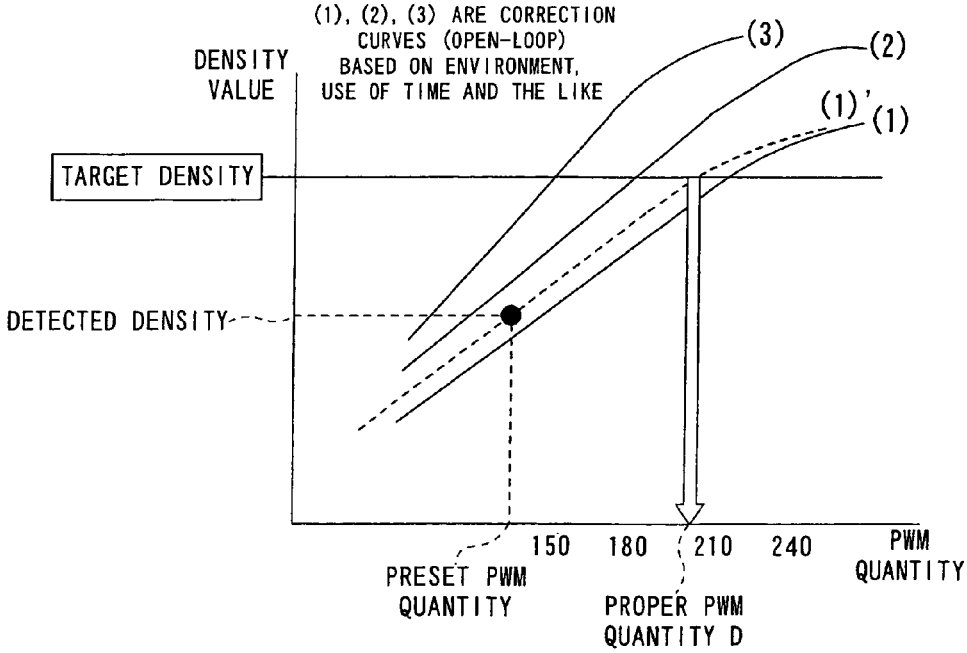
FIG. 15 is a view for explaining a method for deciding a proper PWM value in the second embodiment.

The concept of the calculation of the quasi-proper PWM value D' is shown in FIG. 15. The basic idea is similar to the way of calculating the proper quantity of exposure B in FIG. 14. Plural correction curves (correction information) for each use environment and time of use are provided in advance in the image quality maintenance control unit 4 (in the example shown in FIG. 15, three correction curves (1), (2) and (3) are provided). Then, in accordance with the temperature/humidity sensor, the time of use counter and the like, which are separately provided, a correction curve that is closest to the current environment, for example, the correction curve (1), is selected.

Meanwhile, the density for the preset PWM value (in this case, reference PWM value C) is detected (in FIG. 15, too, this detected density is indicated by a filled dot). Using this detected density, the correction curve that is closest to the current environment, for example, the correction curve (1), is further corrected. For example, the correction curve (1) is shifted so that the correction curve (1) overlaps the filled dot, thus generating a correction curve (1)' (correction curve of broken line). Using this correction curve (1)', a quasi-proper PWM value D' corresponding to the reference density (second reference density) is calculated.

Finally, in step ST27, the quasi-proper PWM value D' is converted to a proper PWM value D. In the first embodiment, after the proper quantity of exposure B is decided, the solid pattern image patch P12 is formed by using this proper quantity of exposure B, and the proper PWM value D is decided on the basis of its density.

On the other hand, in the second embodiment, the solid pattern image patch P12 printed in step ST23 uses the reference quantity of exposure A set by open-loop control, instead of the proper quantity of exposure B. Thus, the correction of this is necessary.

The correction from the quasi-proper PWM value D' to the proper PWM value Duses, for example, the following transformation formula.

Proper *PWM* value D=(quasi-proper *PWM* value *D*')* (proper quantity of exposure *B*/reference quantity of exposure *A*)

In this manner, the proper PWM value D is decided.

The image quality maintenance control method according to the second embodiment has slightly lower accuracy than the first embodiment, in that the correction curves shown in FIG. 14 and FIG. 15 are used and that the above transformation formula is used. However, since the micro-point pattern and the solid pattern are printed simultaneously, and the preset quantity of exposure and the preset PWM value in this case take a single value instead of plural values, the proper quantity of exposure B and the proper PWM value D can be decided within a short period.

(5) Image Quality Maintenance Control Method (Third Embodiment)

Intermediate selections are possible between the first embodiment and the second embodiment. For example, there are the following choices.

(a-1) First, a micro-point pattern is printed and a proper quantity of exposure B is decided. Next, a proper PWM value D is found from an image patch formed by using the proper quantity of exposure B.

(a-2) From an image patch in which a micro-point pattern and a solid pattern are formed in parallel by using a reference quantity of exposure A and a reference PWM value C, which are open-loop control values, a proper quantity of exposure B and a quasi-proper PWM value D' are found. After that, the quasi-proper PWM value D' is corrected to a proper PWM value D.

(b-1) A proper quantity of exposure B is decided from plural detected densities by using a linear regression method or the like.

(b-2) A proper quantity of exposure B is decided by using one detected density and a correction curve.

(c-1) A proper PWM value D (or quasi-proper PWM value D') is decided from plural detected densities by using a linear regression method or the like.

(c-2) A proper PWM value D (or quasi-proper PWM value D') is decided from one detected density and a correction curve.

Figure 16:
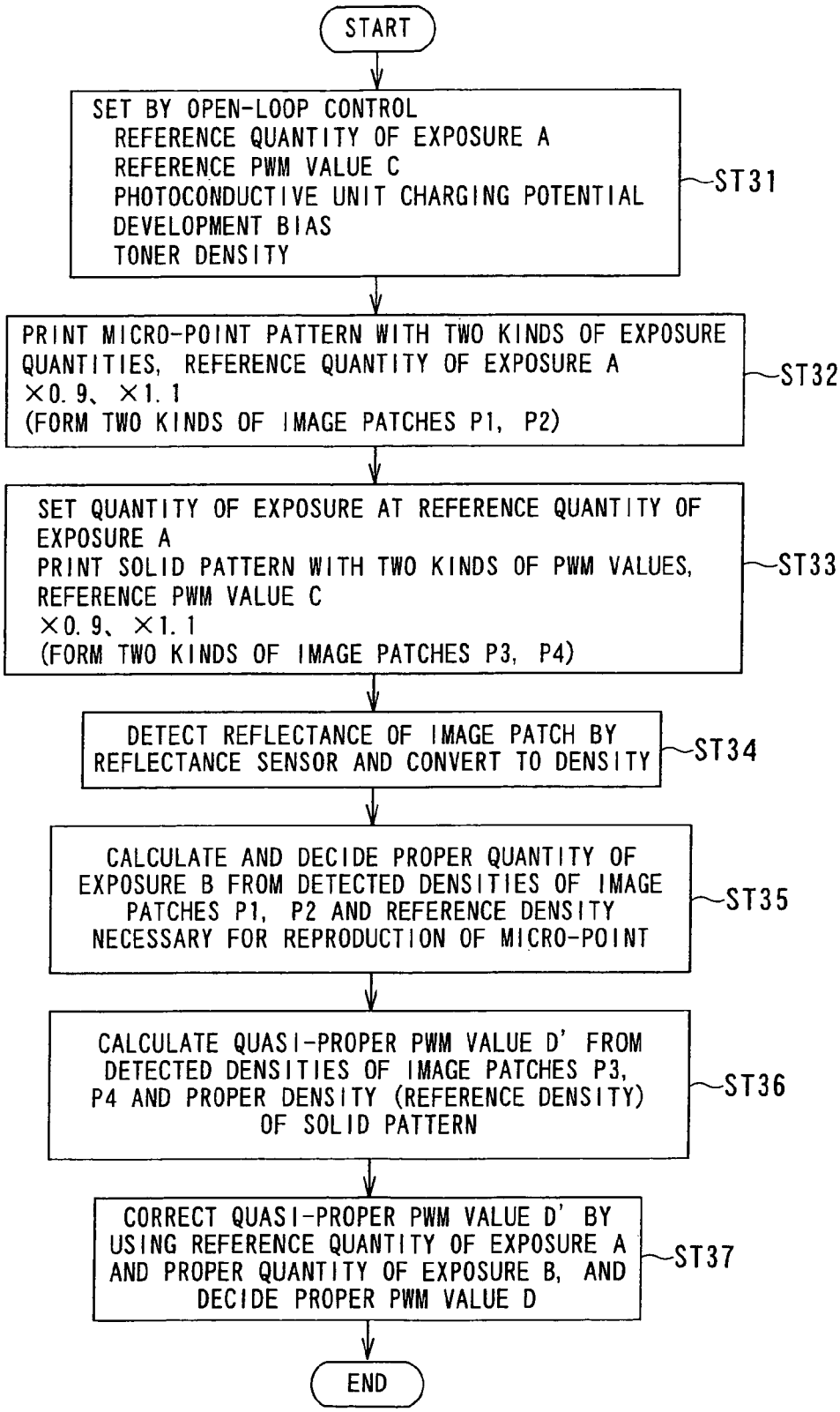
FIG. 16 is a flowchart showing an example of processing in an image quality maintenance control method according to a third embodiment.

An image quality maintenance control method according to a third embodiment shown in FIG. 16 is an image quality maintenance control method in which (a-2), (b-1) and (c-1) are selected from the above choices. The detailed description thereof will not be made in order to avoid duplication.

By the way, the first embodiment is an image quality maintenance control method in which (a-1), (b-1) and (c-1) are selected from the above choices. The second embodiment is an image quality maintenance control method in which (a-2), (b-2) and (C-2) are selected.

(6) Image Quality Maintenance Control Method (Fourth Embodiment)

In the first to third embodiments, the proper quantity of exposure B and the proper PWM value D are decided in order to maintain and set the density of a micro-point and the density of a solid area at their respective reference densities. In the entire discussion about "density" up to this point, the level of a pixel signal (hereinafter referred to as gradation value) is at the maximum. That is, a "density corresponding to a gradation value 255" is used, where the gradation value of a pixel signal is expressed by 8 bits.

The fourth and fifth embodiments, which will be described hereinafter, relate to a method for properly maintaining and setting the density of intermediate gradation (gradation values of 0 to 255).

A gradation value is usually realized by using an intermediate gradation pattern. For example, 256 types of different intermediate gradation patterns are provided with respect to the gradation values of 0 to 255. One intermediate gradation pattern is selected from these plural intermediate gradation patterns in accordance with the gradation value of a pixel, and a pixel image is formed. This technique is employed also in this embodiment.

The density of intermediate gradation is naturally affected by the use environment and the time of use. Therefore, to maintain an initially set gradation curve (gradation value versus density characteristic), image quality maintenance control is necessary.

Figure 17:
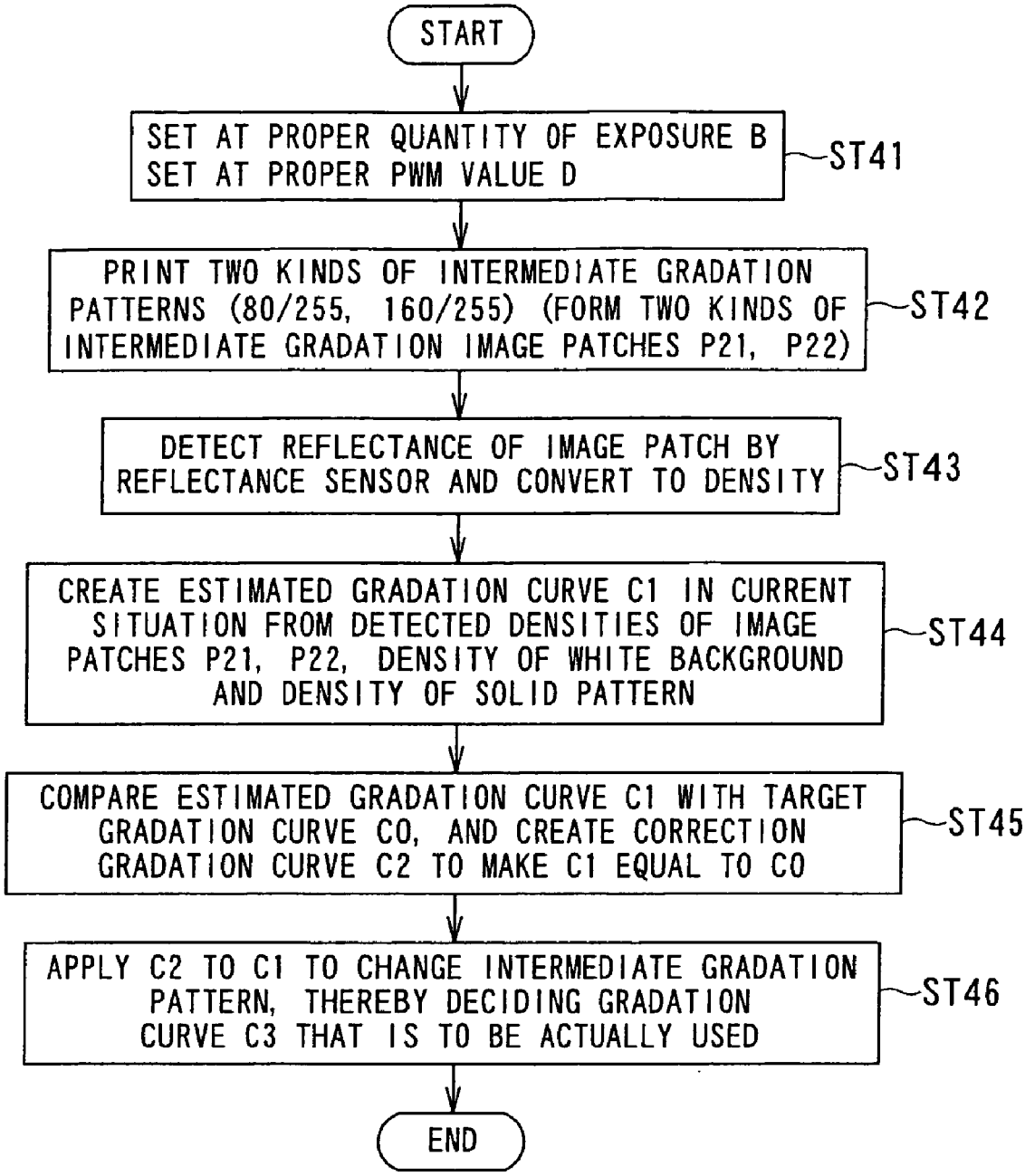
FIG. 17 is a flowchart showing an example of processing in an image quality maintenance control method according to a fourth embodiment.
Figure 18:
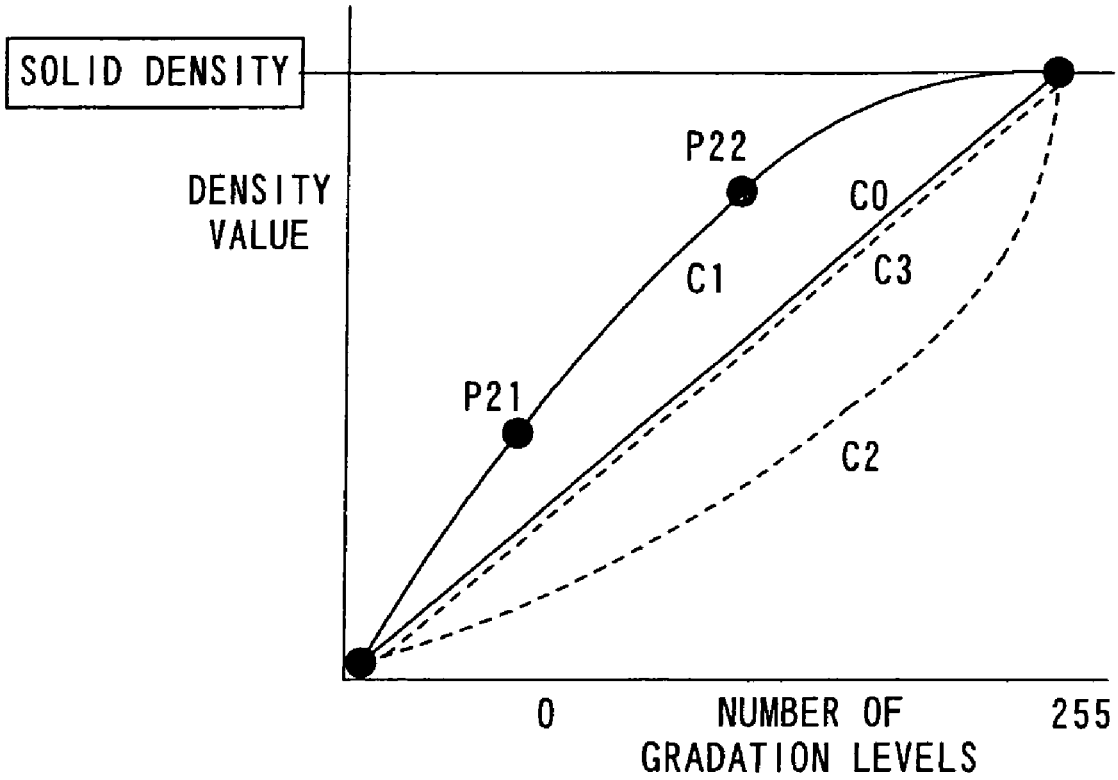
FIG. 18 is a view for explaining an exemplary method for correcting a gradation curve in the fourth embodiment.

The flowchart of FIG. 17, and FIG. 18 show an example of processing for maintenance control of intermediate gradation by closed-loop control.

First, in step ST41, the proper quantity of exposure B and the proper PWM value D that are already decided in the first to third embodiments are set.

Next, for example, intermediate gradation image patches P21 and P22 corresponding to two kinds of intermediate gradation patterns (80/255) and (160/255) are formed on the intermediate transfer belt 11 (step ST42).

Then, the densities of the intermediate gradation image patches P21 and P22 are detected (step ST43).

Next, an estimated gradation curve C1 in the current situation is created from the detected densities of the intermediate gradation image patches P21 and P22, the density of white background, and the density of a solid pattern (step ST44). Here, as the density of the solid pattern, the density acquired in the first to third embodiments may be used. Alternatively, a solid pattern (equivalent to an intermediate gradation pattern (255/255)) may be additionally formed when forming the intermediate gradation image patches P21 and P22, and its density may be detected.

Next, the estimated gradation curve C1 is compared with a target gradation curve C0, and a correction gradation curve C2 that makes C1 equal to C0 is created (step ST45).

Next, C2 is applied to C1 to change the intermediate gradation pattern, thereby deciding a gradation curve C3 that is to be actually used.

(7) Image Quality Maintenance Control Method (Fifth Embodiment)

Figure 19:
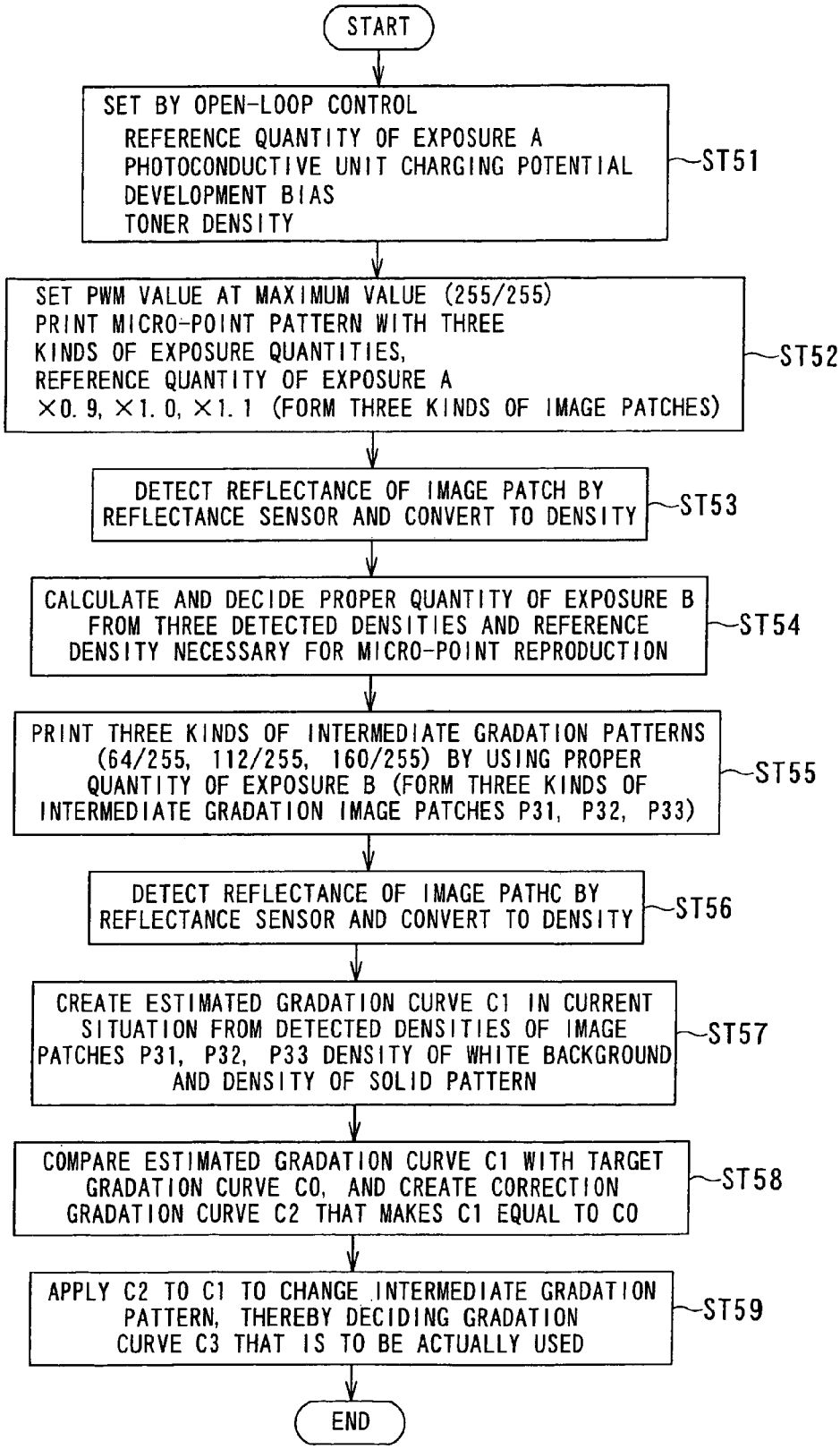
FIG. 19 is a flowchart showing an example of processing in an image quality maintenance control method according to a fifth embodiment.
Figure 20:
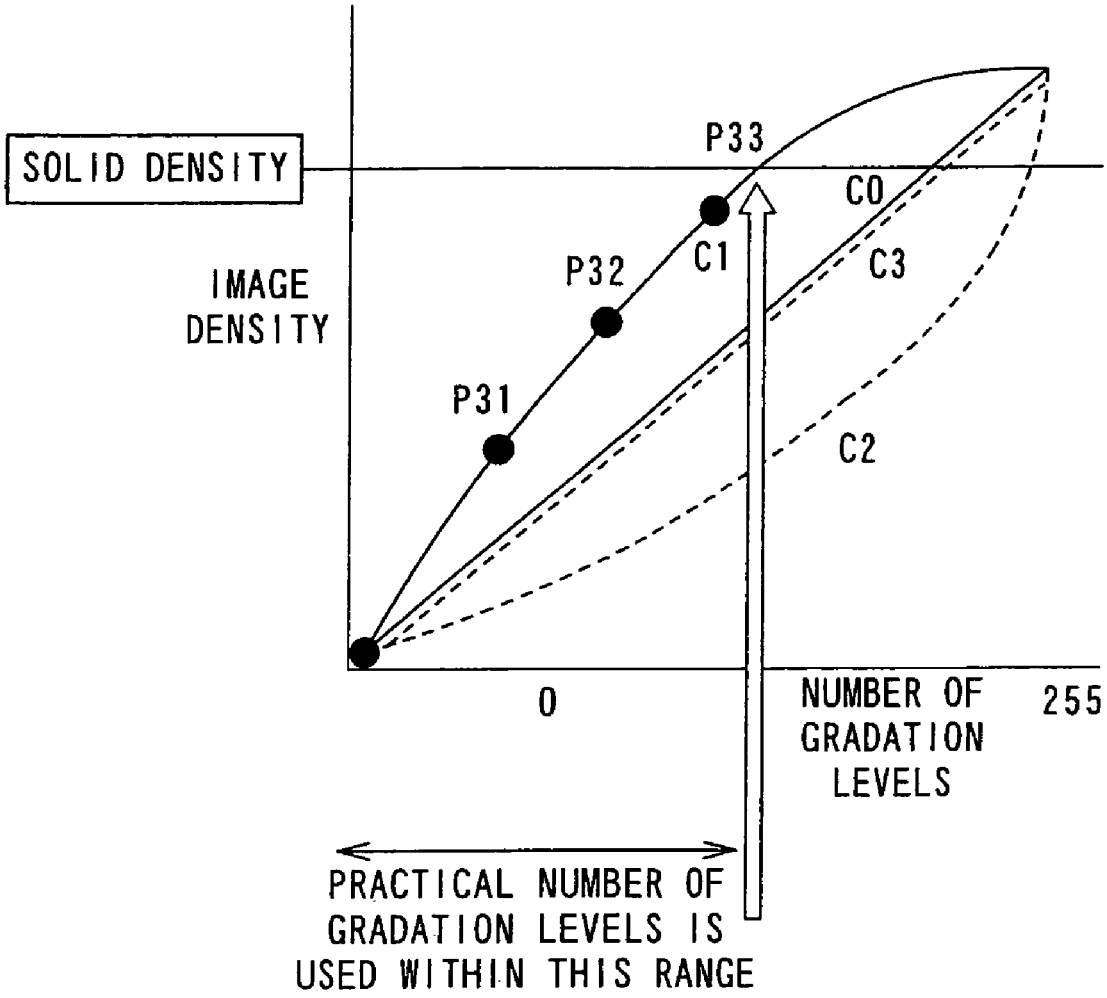
FIG. 20 is a view for explaining an exemplary method for correcting a gradation curve in the fifth embodiment.

FIG. 19 and FIG. 20 are flowchart and explanatory view showing an example of processing in an image quality maintenance control method according to a fifth embodiment. The flowchart shown in FIG. 19 shows the processing to decide a proper quantity of exposure B that maintains the density of a micro-point and to decide a gradation curve C3.

The processing of steps ST51 to ST54 is the same as the processing according to the first embodiment (steps ST1 to ST4). In these processing steps, a proper quantity of exposure B that allows the density of a micro-point to be equal to the reference density is decided.

In step ST55, for example, three kinds of intermediate gradation patterns (64/255), (112/255) and (160/255) are printed by using the proper quantity of exposure B, and three kinds of intermediate gradation image patches P31, P32 and P33 are formed on the intermediate transfer belt 11.

Next, in step ST56, the densities of these intermediate gradation image patches P31, P32 and P33 are detected.

In step ST57, an estimated gradation curve C1 in the current situation is created from the detected densities of the intermediate gradation image patches P31, P32 and P33, the density of white background, and the density of a solid pattern.

In the next step ST58, the estimated gradation curve C1 is compared with a target gradation curve C0, and a correction gradation curve C2 that makes C1 equal to C0 is created.

Next, C2 is applied to C1 to change the intermediate gradation pattern, thereby deciding a gradation curve C3 that is to be actually used.

As can be understood from the flowchart of FIG. 19, in the fifth embodiment, the decision of a proper PWM value D that allows the density of the solid area to be equal to the reference density is skipped. Therefore, as the PWM value, the reference PWM value C is used, which is an open-loop control value.

As a result, when a solid pattern (with a gradation value (255/255)) is used as an intermediate gradation pattern, in some cases, its density may be higher than the reference density of the solid pattern (see FIG. 20).

However, as can be seen from FIG. 20, if the gradation value corresponding to the reference density of the solid pattern (second reference density) is, for example, (160/255), its density can be prevented from becoming excessively high by limiting the maximum value of the gradation value to select an intermediate gradation pattern to (160/255).

According to the fifth embodiment, the gradation curve is corrected, thereby adjusting the density of a solid area without changing the PWM value from the reference PWM value C, and when the solid pattern is printed, it is actually printed as an intermediate gradation pattern. Even if the pattern is not a solid pattern, the quantity of attached toner is equivalent to that of a solid pattern or more, and therefore a desired solid density can be realized.

However, unlike the fourth embodiment, the apparent number of gradation levels is reduced from 255 gradation levels, for example, to 160 gradation levels. In this case, correspondence processing to make the 160 gradation levels appear as the 255 gradation levels can be provided separately.

As an advantage of the fifth embodiment, since the adjustment of the density of a solid area and the correction of intermediate gradation can be carried out at a time after the proper quantity of exposure B for reproduction of a micro-point or thin line is decided, it is possible to reduce the control time.

(8) Comparative Tests

FIG. 21 shows the results of comparing the gradation stability and the reproducibility of a micro-point in accordance with the environmental conditions and the time of use, between a case where the above-described image quality maintenance control was performed and a case where it was not performed.

In Test Nos. 1 to 10, the quantity of exposure was manually varied, and the reproducibility of an isolated point (micro-point) and the density of a solid area (solid density) were compared.

Since the solid density is substantially decided by the development contrast potential, the photoconductive unit charging potential and the like were adjusted to realize substantially the same value (300 V) in Test Nos. 1, 2, 4, 6, 7, 9 and 10. For the reproducibility of a micro-point, whether an isolated point of one dot at 600 dpi (diameter 42 μm) was reproduced or not is evaluated at three levels, that is, o=good, Δ=indistinct but can be roughly distinguished, and ×=cannot be reproduced, by viewing an enlarged image with naked eyes.

As a result, it can be understood that the micro-point reproducibility is good if the quantity of exposure is larger than approximately twice the half-potential exposure quantity of the photoconductive unit, whereas the micro-point cannot be reproduced if the quantity of exposure is smaller. In Test Nos. 3, 5 and 8, the charging potential and the development bias were changed and the development contrast was made higher than in the other cases in order to achieve o (good) reproduction of the micro-point. In this situation, the micro-point was reproduced in a good condition even with a quantity of exposure equal to or less than the half-potential exposure quantity. However, the solid density is 1.6 or more in any of these cases, and the quantity of developed toner in the solid area is excessively large.

On the other hand, cases of applying the embodiments are shown in Test No. 11 and the subsequent tests. Basically, the charging potential was set at −780 to −800 V and the development bias was set at −650 to −670 V.

In Test No. 11, a micro-point patch as shown in FIG. 8 was printed with the quantity of exposure changed in three stages (0.27, 0.3 and 0.33 μJ/cm2), and the reflectance was detected by the sensor and converted to a density value.

Meanwhile, the reference density (first reference density) of the pattern of FIG. 8 in the case where micro-point reproduction is sufficient is 0.4. Since the density values detected by the sensor are 0.35, 0.38 and 0.43, the proper quantity of exposure to realize the reference density was calculated as 0.31 μJ/cm2.

After the reproduction of the micro-point is first secured by the setting of the proper quantity of exposure, a solid patch was printed next. When three kinds of PWM values PWM (168/255), PWM (200/255) and PWM (232/255) were used, the detection values by the sensor were 1.25, 1.5 and 1.6, while a target density being 1.5. Thus, the proper PWM value D of the solid part was calculated as PWM (200/255).

Using these proper quantity of exposure and proper PWM value, the printing processing shown in FIG. 11 is performed and the density was measured. In Test No. 11, with a quantity of exposure less than twice the half-potential exposure quantity of the photoconductive unit, the micro-point reproduction was o (good) and a proper solid density (1.5) was be provided.

Although the target value of the solid density is defined as 1.5 here, it can be arbitrarily set in accordance with the specifications of the apparatus. In many of the recent printers, the solid density is set at approximately 1.3. Under such a condition, it is difficult to realize both the micro-point reproduction and the solid density. Therefore, this invention is effective.

Test Nos. 12 to 19 are cases where the number of micro-point patches and the number of solid patches were reduced. When the number of patches was reduced, though the accuracy in calculation is expected to be lowered, the result substantially equivalent to Test No. 11 was acquired and it was found that these cases were effective. In the case where one patch is used, accurate estimation is difficult. However, when it is determined that the environment is highly humid, for example, by a temperature/humidity sensor, the quantity of light is lowered in advance and exposure can be performed with this setting. Moreover, even if deviation from a target value is large, several types of correction coefficients can be decided in order to reduce the quantity of light to be corrected, compared with a low-temperature low-humidity environment.

Test Nos. 20 to 23 are cases where the correction of the quantity of exposure based on the patch printing and the correction of the PWM value of the solid part were controlled while printing both patches almost simultaneously (equivalent to the second embodiment). By using the above-described method, both a good micro-point reproduction and a proper solid density were achieved. Also, in Test Nos. 20 to 23, gradation correction control based on an intermediate gradation pattern was additionally performed. In this case, too, the changes in the intermediate gradation density with varied environments were kept within ±0.06 or less at the maximum.

In Test Nos. 24 and 25, after a quantity of exposure that enables reproduction of a micro-point is decided without changing the PWM value of a solid part, gradation correction based on a pattern was performed, while the solid part not being treated as an actual solid part. Even in this case (equivalent to the fifth embodiment), a proper solid density (1.5) was obtained.

The solid area in this case had a gradation value (196/255) in a normal-temperature normal-humidity environment and therefore was not actually a solid pattern. However, in terms of density, a satisfactory control result was obtained, including stability of an intermediate gradation pattern.

With the image forming apparatus 1 according to the embodiment, even in the case where the quantity of exposure is set at a lower level than in the conventional technique, good reproducibility of a micro-point or thin line can be maintained irrespective of changes in the environment and the time of use, and stability of the density of a solid area can be secured. Also, since stable gradation reproducibility can be maintained for a long period, high image quality can be maintained.

Also, since the quantity of exposure can be reduced compared to the conventional level, it can contribute to higher speed and lower cost of the apparatus.

Moreover, even in the case where the diameter of exposure beam is increased in order to reduce the cost of the apparatus, or even in the case where the thickness of the charge carrying layer is increased in order to increase the life of the organic photoconductive unit, the apparatus can be used without deteriorating the image quality. Therefore, further reduction in the cost can be realized.

This invention is not limited to the above embodiments, and in practice, the constituent elements can be modified and embodied without departing from the scope of the invention. Also, various inventions can be made by appropriate combinations of plural constituent elements disclosed in the embodiments. For example, of all the constituent elements disclosed in the embodiments, several constituent elements can be deleted. Moreover, the constituent elements disclosed in the different embodiments can be properly combined.

What is claimed is:

1. An image forming apparatus comprising:

a photoconductive unit;

an exposure unit configured to output a pulse-width-modulated light signal and expose the photoconductive unit;

a developing unit configured to develop the photoconductive unit and form a developed image on the photoconductive unit;

a transfer unit configured to transfer the developed image to a transfer target unit and form a transferred image;

an image patch generating unit configured to generate an image patch formed by a predetermined pattern;

a sensor unit configured to detect density information of a developed image of the image patch formed on the photoconductive unit or a transferred image of the image patch formed on the transfer target unit; and an image quality maintenance control unit configured to decide a proper quantity of exposure and a proper pulse width on the basis of the density information detected by the sensor unit and set the decided proper quantity of exposure and the proper pulse width in the exposure unit, wherein the image patch generating unit generates a first image patch having a micro-point or thin line as a first pattern and a second image patch having a high-density pattern as a second pattern, and wherein the image quality maintenance control unit decides the proper quantity of exposure based on the density information of the first image patch detected by the sensor unit when a maximum pulse width is set in the exposure unit, and decides the proper pulse width based on the density information of the second image patch detected by the sensor unit when the decided proper quantity of exposure is set in the exposure unit.

2. The image forming apparatus according to claim 1, wherein the image quality maintenance control unit decides the proper quantity of exposure, from a plurality of the density information of the first image patch acquired by setting plural quantities of exposure and a first reference density that is preset for the first pattern, and decides the proper pulse width from a plurality of the density information of the second image patch acquired by setting plural pulse widths and a second reference density that is preset for the second pattern.

3. The image forming apparatus according to claim 1, wherein the image quality maintenance control unit decides the proper quantity of exposure, from a plurality of the density information of the first image patch acquired by setting plural quantities of exposure and a first reference density that is preset for the first pattern, and corrects the density information of the second image patch acquired by setting a specific pulse width, by using preset correction information, and decides the proper pulse width from the corrected density information and a second reference density that is preset for the second pattern.

4. The image forming apparatus according to claim 1, wherein the image patch generating unit generates a first image patch having a micro-point or thin line as a first pattern and a second image patch having a high-density pattern as a second pattern, and wherein the image quality maintenance control unit decides the proper quantity of exposure based on the density information of the first image patch detected by the sensor unit when a maximum pulse width is set in the exposure unit, and decides the proper pulse width from the density information of the second image patch detected by the sensor unit simultaneously when the maximum pulse width is set in the exposure unit, the decided proper quantity of exposure, and a second reference density that is preset for the second pattern.

5. The image forming apparatus according to claim 4, wherein the image quality maintenance control unit decides the proper quantity of exposure, from a plurality of the density information of the first image patch acquired by setting plural quantities of exposure and a first reference density that is preset for the first pattern, and corrects the density information of the second image patch acquired by setting a specific pulse width, by using preset correction information, and decides the proper pulse width from the corrected density information and a second reference density that is preset for the second pattern.

6. The image forming apparatus according to claim 4, wherein the image quality maintenance control unit corrects the density information of the first image patch acquired by setting a specific quantity of exposure, by using preset correction information, and decides the proper quantity of exposure from the corrected density information and a first reference density that is preset for the first pattern, and corrects the density information of the second image patch acquired by setting a specific pulse width, by using preset correction information, and decides the proper pulse width from the corrected density information and a second reference density that is preset for the second pattern.

7. The image forming apparatus according to claim 1, further comprising a gradation processing unit having a set of intermediate gradation patterns that represent densities of intermediate gradation levels and a density conversion table that associates the densities of the intermediate gradation levels with the intermediate gradation patterns, and configured to select one of the intermediate gradation patterns from the density conversion table in accordance with density of inputted image data and output it to the exposure unit, wherein the image patch generating unit further generates plural third image patches having densities of intermediate gradation levels, and the image quality maintenance control unit corrects the density conversion table, by a plurality of the density information of the third image patches detected by the sensor unit when the decided proper quantity of exposure and the decided proper pulse width are set in the exposure unit, and plural third reference densities that are preset for the plural third image patches.

8. The image forming apparatus according to claim 4, further comprising a gradation processing unit having a set of intermediate gradation patterns that represent densities of intermediate gradation levels and a density conversion table that associates the densities of the intermediate gradation levels with the intermediate gradation patterns, and configured to select one of the intermediate gradation patterns from the density conversion table in accordance with density of inputted image data and output it to the exposure unit, wherein the image patch generating unit further generates plural third image patches having densities of intermediate gradation levels, and the image quality maintenance control unit corrects the density conversion table, by a plurality of the density information of the third image patches detected by the sensor unit when the decided proper quantity of exposure and the decided proper pulse width are set in the exposure unit, and plural third reference densities that are preset for the plural third image patches.

9. The image forming apparatus according to claim 1, further comprising a gradation processing unit having a set of intermediate gradation patterns that represent densities of intermediate gradation levels and a density conversion table that associates the densities of the intermediate gradation levels with the intermediate gradation patterns, and configured to select one of the intermediate gradation patterns from the density conversion table in accordance with density of inputted image data and output it to the exposure unit, wherein the image patch generating unit generates a first image patch having a micro-point or thin line as a first pattern and plural third image patches having densities of intermediate gradation levels, and wherein the image quality maintenance control unit decides the proper quantity of exposure based on the density information of the first image patch detected by the sensor unit when a maximum pulse width is set in the exposure unit, and corrects the density conversion table, by a plurality of the density information of the third image patches detected by the sensor unit when the decided proper quantity of exposure and the decided maximum pulse width are set in the exposure unit, and plural third reference densities that are preset for the plural third image patches.

10. The image forming apparatus according to claim 1, wherein the quantity of exposure outputted from the exposure unit is less than twice a half-potential exposure quantity of the photoconductive unit.

11. The image forming apparatus according to claim 1, wherein an average of diameters of exposure beams in the exposure unit is 70 μm or more.

12. The image forming apparatus according to claim 1, further comprising an image identifying unit configured to identify a micro-point or thin line area in image data and a solid pattern area where pixels continuously spread in a predetermined area, wherein the image quality maintenance control unit sets the proper quantity of exposure in the exposure unit for the micro-point or thin line area identified by the image identifying unit, and sets the proper quantity of exposure and the proper pulse width for the solid pattern area identified by the image identifying unit.

13. An image forming method for an image forming apparatus comprising a photoconductive unit, an exposure unit configured to output a pulse-width-modulated light signal and expose the photoconductive unit, a developing unit configured to develop the photoconductive unit and form a developed image on the photoconductive unit, and a transfer unit configured to transfer the developed image to a transfer target unit and form a transferred image, the image forming method, comprising:

generating an image patch formed by a predetermined pattern;

detecting density information of a developed image of the image patch formed on the photoconductive unit or a transferred image of the image patch formed on the transfer target unit by a sensor unit;

deciding a proper quantity of exposure and a proper pulse width on the basis of the detected density information; and setting the decided proper quantity of exposure and the proper pulse width in the exposure unit, wherein in the generating the image patch, a first image patch having a micro-point or thin line as a first pattern and a second image patch having a high-density pattern as a second pattern are generated, and wherein in the deciding, the proper quantity of exposure is decided based on the density information of the first image patch detected by the sensor unit when a maximum pulse width is set in the exposure unit, and the proper pulse width is decided based on the density information of the second image patch detected by the sensor unit when the decided proper quantity of exposure is set in the exposure unit.

14. The image forming method according to claim 13, wherein in the generating the image patch, a first image patch having a micro-point or thin line as a first pattern and a second image patch having a high-density pattern as a second pattern are generated, and wherein in the deciding, the proper quantity of exposure is decided based on the density information of the first image patch detected by the sensor unit when a maximum pulse width is set in the exposure unit, and the proper pulse width is decided from the density information of the second image patch detected by the sensor unit simultaneously when the maximum pulse width is set in the exposure unit, the decided proper quantity of exposure, and a second reference density that is preset for the second pattern.

15. The image forming method according to claim 13, wherein, the image forming apparatus includes a set of intermediate gradation patterns that represent densities of intermediate gradation levels and a density conversion table that associates the densities of the intermediate gradation levels with the intermediate gradation patterns, and wherein, the image forming method includes;

selecting one of the intermediate gradation patterns from the density conversion table in accordance with density of inputted image data and outputting it to the exposure unit, wherein in the generating the image patch, plural third image patches having densities of intermediate gradation levels are further generated, and in the deciding, the density conversion table is corrected by a plurality of the density information of the third image patches detected by the sensor unit when the decided proper quantity of exposure and the decided proper pulse width are set in the exposure unit, and plural third reference densities that are preset for the plural third image patches.

16. The image forming method according to claim 14, wherein, the image forming apparatus includes a set of intermediate gradation patterns that represent densities of intermediate gradation levels and a density conversion table that associates the densities of the intermediate gradation levels with the intermediate gradation patterns, and wherein, the image forming method includes selecting one of the intermediate gradation patterns from the density conversion table in accordance with density of inputted image data and outputting it to the exposure unit, wherein in the generating the image patch, plural third image patches having densities of intermediate gradation levels are further generated, and in the deciding, the density conversion table is corrected by a plurality of the density information of the third image patches detected by the sensor unit when the decided proper quantity of exposure and the decided proper pulse width are set in the exposure unit, and plural third reference densities that are preset for the plural third image patches.

17. The image forming method according to claim 13, wherein, the image forming apparatus includes a set of intermediate gradation patterns that represent densities of intermediate gradation levels and a density conversion table that associates the densities of the intermediate gradation levels with the intermediate gradation patterns, and wherein, the image forming method includes;

selecting one of the intermediate gradation patterns from the density conversion table in accordance with density of inputted image data and outputting it to the exposure unit, wherein in the generating the image patch, a first image patch having a micro-point or thin line as a first pattern and plural third image patches having densities of intermediate gradation levels are generated, and in the deciding, the proper quantity of exposure is decided based on the density information of the first image patch detected by the sensor unit when a maximum pulse width is set in the exposure unit, and the density conversion table is corrected by a plurality of the density information of the third image patches detected by the sensor unit when the decided proper quantity of exposure and the decided maximum pulse width are set in the exposure unit, and plural third reference densities that are preset for the plural third image patches.

18. The image forming method according to claim 13, further comprising identifying a micro-point or thin line area in image data and a solid pattern area where pixels continuously spread in a predetermined area, wherein in the setting, the proper quantity of exposure is set in the exposure unit for the micro-point or thin line area identified by the image identifying unit, and the proper quantity of exposure and the proper pulse width are set for the solid pattern area identified by the image identifying unit.

* * * * *